US005809745A

United States Patent [19]

Reinert

[11] Patent Number: 5,809,745

[45] Date of Patent: Sep. 22, 1998

[54] APPARATUS AND METHOD FOR STACKING AND PACKING ARTICLES

[75] Inventor: Charles Reinert, Alton, Iowa

[73] Assignee: Excel Corporation, Wayzata, Minn.

[21] Appl. No.: 483,955

[22] Filed: Jun. 7, 1995

[51] Int. Cl.[6] ..... B65B 35/50

[52] U.S. Cl. ..... 53/447; 53/386.1; 53/284.7; 53/540; 53/258; 53/261; 53/448; 53/459; 53/469; 53/532; 53/541; 53/542; 53/570; 53/572

[58] Field of Search ..... 198/789.2, 794.9, 198/795, 795.3; 53/284.7, 447, 448, 459, 469, 258, 532, 541, 542, 570, 571, 572, 573, 540, 261, 386.1

[56] References Cited

U.S. PATENT DOCUMENTS

| | | | |
|---|---|---|---|
| 3,022,620 | 2/1962 | Gallet | 53/540 X |
| 3,107,793 | 10/1963 | Frank | 53/541 X |
| 3,424,294 | 1/1969 | Felstehausen . | |
| 3,490,195 | 1/1970 | Abramson | 53/572 X |
| 3,566,576 | 3/1971 | Ayres et al. | 53/540 X |
| 3,743,118 | 7/1973 | Fluck | 414/794.9 X |
| 3,772,040 | 11/1973 | Benson et al. . | |
| 3,810,344 | 5/1974 | Evans et al. | 414/789.2 X |
| 3,810,554 | 5/1974 | London et al. . | |
| 3,811,549 | 5/1974 | Preisig . | |
| 3,815,321 | 6/1974 | Hartman | 53/541 X |
| 3,849,969 | 11/1974 | Paules . | |
| 3,859,775 | 1/1975 | Kihnke . | |
| 3,866,741 | 2/1975 | Carbon et al. . | |
| 3,870,139 | 3/1975 | Wagner . | |
| 3,952,478 | 4/1976 | Richards et al. . | |
| 3,959,951 | 6/1976 | Paules . | |
| 3,962,845 | 6/1976 | Mojden et al. . | |
| 3,971,191 | 7/1976 | Hoyland . | |
| 4,026,421 | 5/1977 | Lotz . | |
| 4,035,982 | 7/1977 | Paules . | |
| 4,137,604 | 2/1979 | Sandberg et al. . | |
| 4,137,958 | 2/1979 | Golby et al. | 53/572 X |
| 4,151,930 | 5/1979 | Baker et al. . | |
| 4,242,854 | 1/1981 | Nissen | 53/386.1 X |
| 4,248,032 | 2/1981 | Woods et al. | 53/386.1 X |
| 4,352,265 | 10/1982 | Hansel et al. | 414/795 X |
| 4,421,222 | 12/1983 | Stuermer . | |
| 4,505,093 | 3/1985 | Johnson . | |
| 4,537,550 | 8/1985 | Mojden et al. | 53/541 X |
| 4,679,379 | 7/1987 | Cassoli | 53/540 X |
| 4,755,093 | 7/1988 | Francioni | 53/541 X |
| 4,802,808 | 2/1989 | Wolk et al. | 53/541 X |
| 4,827,692 | 5/1989 | Fiske et al. . | |
| 4,939,891 | 7/1990 | Podini | 53/540 X |
| 5,069,019 | 12/1991 | Lodewagen . | |
| 5,127,544 | 7/1992 | Robinson et al. . | |
| 5,131,803 | 7/1992 | Banek . | |
| 5,135,763 | 8/1992 | Gillam et al. . | |
| 5,165,218 | 11/1992 | Callahan, Jr. . | |
| 5,273,167 | 12/1993 | Haas et al. | 414/795.3 X |
| 5,414,978 | 5/1995 | Limousin | 53/541 X |
| 5,484,050 | 1/1996 | Cheatham | 53/541 X |

FOREIGN PATENT DOCUMENTS

| | | |
|---|---|---|
| 849461 | 8/1970 | Canada . |

OTHER PUBLICATIONS

Brochure from API Automation Packaging, Inc., entitled *Patty Stacker Shrink Warppers*, 4 pgs.

*Primary Examiner*—Daniel Moon

*Attorney, Agent, or Firm*—Merchant, Gould, Smith, Edell, Welter & Schmidt, P.A.

[57] ABSTRACT

An apparatus and method for continuously counting, stacking, and packaging relatively rigid and stackable articles, such as frozen meat patties, is provided. The apparatus includes a bottom stacker for stacking stackable articles in a column, a stack mover for moving the stack of articles to a packaging station, and a packager for packaging the stack of articles. The packager can provide an open plastic bag without injecting air.

15 Claims, 17 Drawing Sheets

APPARATUS AND METHOD FOR STACKING AND PACKING ARTICLES

FIELD OF THE INVENTION

The present invention relates to apparatus and method for stacking and/or packaging articles, and more particularly to apparatus and method for stacking and packaging relatively rigid and stackable articles, such as frozen meat patties.

BACKGROUND OF THE INVENTION

Many quick service restaurants and cafeterias which prepare and sell hamburgers require large quantities of preformed, frozen hamburger patties which can be cooked and sold to their customers. In order to satisfy this demand, preformed, frozen hamburgers are generally molded and dry-frozen in a high speed machine. A commonly used patty forming machine is a FORMAX machine sold by Formax, Inc. of Mokena, Ill. The frozen meat patties are then, generally, stacked and packaged by hand. In order to package the frozen meat patties soon after they are formed, a large labor force is needed which is expensive to employ and which requires excessive floor space. In addition, hand stacking and packaging sometimes results in injuries to the workers. Such injuries can be harmful to both worker and employer. In order to overcome these shortcomings, it is desirable to further automate the industry by providing machines which will automatically and continuously stack and package frozen meat patties at a high speed.

Several machines have been designed for packaging frozen hamburgers. Generally, these machines have conveyors which elevate the hamburgers to a desired location where they are dropped or released to form a stack. These machines are generally referred to as top stacking machines. Since they allow the hamburgers to free fall onto a stack, they do not provide adequate control over the processing of meat patties. See, for example, U.S. Pat. No. 5,069,019 which describes a packaging device which provides for a series of hamburger patties to be placed on other hamburger patties; U.S. Pat. No. 3,998,339 where the hamburger patties are dropped onto a stack; U.S. Pat. No. 3,866,741 which describes a free-fall stacker; and U.S. Pat. No. 3,849,969 which describes a stacker where patties are added to the top of a pile. An alternative bottom stacking design is described by U.S. Pat. No. 4,827,692.

When stacking and packaging meat patties, it is important to accurately count the number of patties to control the number shipped to a customer. Workers stacking and packaging meat patties sometimes mistakenly count the number of patties handled. Such errors can be harmful to the company selling the patties. Shipping too many patties causes a loss in revenue, and shipping fewer patties than expected can result in customer complaints and mistrust. Many hamburger patty stacking machines do not count the number of patties stacked. Rather, they stack hamburgers until a specific stack height is achieved which is supposed to correspond to a number of patties stacked. Stacking by height can result in an incorrect number of patties being stacked, particularly when the thickness of individual patties varies. In addition, as the stack height increases, the chance for error increases since the error in the thickness of individual patties becomes magnified. The result is that these machines fail to provide commercially sufficient control over the number of hamburger patties stacked. Accordingly, it is desirable to provide better control of the number of patties stacked and shipped by providing a more reliable means for accurately counting meat patties.

Several machines have been designed to automatically count hamburger patties. Some designs, such as those discussed in U.S. Pat. Nos. 3,810,554 and 5,069,019 utilize an electrical system, such as a photoelectric light source or an electric eye for counting meat patties. Electrically operated counters in meat processing plants, however, are subject to damage from moisture and/or cold which are common to meat processing machinery. In addition, they often miscount. A jolt or drop can trigger electric counters. Repairs or adjustments to electrical counting systems may require highly trained system controls personnel. Since meat processing machines require frequent cleaning with steam and/or hot water, time and care are needed in dismantling certain electrical systems in order to prevent damage. Accordingly, it would be desirable to provide a simple and reliable system for counting meat patties as they are stacked which can withstand common cleaning operations, and reduce the use of electrical systems, and electrical counting systems in particular, in areas of the machinery which are subject to cleaning operations.

The conditions during the stacking of meat patties should be as sanitary as possible. Many of the hamburger patty stacking machines utilize a conveyor that takes the patty to a certain height where it is then dropped to form a stack. In order to keep the conveyor from going too high, the bottom of the stack is often very close to the floor. Since floors are often a source of contaminants, however, it is desirable to provide a stacking apparatus which keeps the stack of patties a distance away from the floor to enhance cleanliness.

Prior packaging apparatus which package frozen meat patties in a plastic bag inject a stream of air into the bag in order to open it for packaging. For example, see U.S. Pat. No. 3,971,191. According to U.S.D.A. regulations, air used to open plastic bags for packaging meat products must be cleaned to certain standards. Unfortunately, providing cleaned air can be expensive.

Stacking and packaging machines for processing large numbers of frozen patties or the like must operate efficiently, at a high rate, and as cheaply as possible. It would be desirable to provide a patty stacking and packaging apparatus which can stack and/or package patties at a rate which is equivalent to or greater than the number of patties formed in a commercially available patty forming machine, and which can accurately count the number of patties processed. Due to the sanitation requirements of the food packaging industry, the machine should be relatively easy to clean.

SUMMARY OF THE INVENTION

Apparatus for stacking and packaging articles are provided by the present invention. The articles for stacking and packaging can be relatively rigid and stackable. Exemplary articles include food and non-food items, such as, frozen meat patties, cookies, crackers, books, tiles, sheets of steel or plywood, lids, and the like. The apparatus includes a bottom stacker, a stack mover, and a packager. Generally, a predetermined number of articles are stacked by the bottom stacker at a stacking station, the stack is moved by the stack mover from the stacking station to a packaging station, and the stack is packaged at the packaging station. Preferably, the stack is packaged into a collapsible container or bag, such as a plastic bag. The bottom stacker stacks articles in a column by adding the articles to a bottom of the column.

The apparatus can be operated continuously, semi-continuously, or intermittently as desired. It is to be understood that a continuous operation is meant to include the situation where the rate of operation of the stacker is controlled by the operation of the packager. Thus, articles are provided to a stacking station at a rate sufficient to keep the stacker in operation until a predetermined number of articles are stacked, the stacking can be hesitated until the stack is moved from the stacking station, then the stacking can be resumed. Semi-continuous or intermittent operation is generally meant to include the situation where the rate of operation of the apparatus is controlled by the rate articles are fed to the stacking station. Thus, the apparatus may delay the stacking until sufficient amounts of articles are fed thereto. Accordingly, the apparatus can cease operation by itself once articles stop arriving.

A method for stacking and packaging articles is provided by the present invention. The method includes the steps of feeding articles to a bottom stacker; bottom stacking fed articles in a column by adding articles to a bottom of the column until a predetermined number of articles are stacked; transferring the predetermined number of stacked articles to a packager for packaging; and packaging the stacked articles in a collapsible bag. In a preferred embodiment, the step of bottom stacking is hesitated prior to the step of transferring. If desired, the method can be automated, and controlled by microprocessors or other controller.

An apparatus for bottom stacking articles is provided by the present invention. The apparatus includes a stacking cam rotationally mounted on an axis to provide a 360 degree rotation, and a disengagement wall. The stacking cam has a protecting surface and a lifting surface constructed and arranged to provide a receiving area where an article is received for stacking. The disengagement wall is provided for removing an article to be stacked from between the protecting surface and the lifting surface of the stacking cam. The disengagement wall is preferably stationary and is located in relation to the stacking cam so as to sweep out the receiving area formed between the protecting surface and the lifting surface of the stacking cam during a 360 degree rotation of the stacking cam. The lifting surface is constructed and arranged to provide elevation of an article deposited thereon by rotation of the stacking cam. Preferably, a column container is provided for holding stacked articles as they are lifted by the lifting surface. The receiving area between the protecting surface and the lifting surface of the stacking cam can be a slot having dimensions sufficient for receiving an article.

It is noted that the stacking cam and the disengagement wall can be used to provide an apparatus for displacing articles. For example, an article can be displaced in any desired direction, such as horizontal, vertical, or combination thereof depending on the arrangement of the axis of rotation. In addition, stacks of one article can be provided, in which case it may not be necessary to provide a column container. It should be appreciated, however, that the column container can be a wall, bar, or cylinder which holds articles in place once they removed from the receiving area.

A method for stacking articles is provided by the present invention. The method includes the steps of feeding an article to an apparatus for bottom stacking having a stacking cam rotationally mounted on an axis to provide a 360 degree rotation, and rotating the stacking cam 360 degrees about its axis. The method can additionally include a step of bottom stacking articles into a column or column container. Preferably, the method is used for stacking frozen meat patties which can then be packaged.

An apparatus for stack moving, also called a stack mover, is provided by the present invention. The stack mover can include a sliding surface having a surface which is sufficiently smooth to allow a stack of articles to slide thereacross; a pusher for moving a stack across the sliding surface; and a dumper assembly pivotably mounted to rotate between a first position and a second position. The dumper assembly can include a receiving surface and a rotatable semi-cylinder. The receiving surface can be sufficiently continuous and coplaner with the sliding surface for receiving a stack therefrom when the dumper assembly is in the first position. The rotatable semi-cylinder can be constructed and arranged to support and release a stack when the dumper assembly is in the second position. Preferably, the dumper assembly further includes a plunger opposed to the receiving surface for holding a stack of articles in position against the receiving surface along the rotatable semi-cylinder. It should be appreciated that the semi-cylinder can be a bar or some other type of support.

A method for transferring a stack of articles to a new position is provided by the present invention. The method includes the steps of pushing a stack of articles into a dumper assembly pivotably mounted to rotate between a first position and a second position; pivoting the dumper assembly into the second position; and releasing the stack of articles. The dumper assembly can include the components described above, and the step of releasing can include rotating the semi-cylinder.

An apparatus for packaging is provided by the present invention. The apparatus can be referred to as a packager, and the apparatus can be used to package stacks and non-stacks of articles in a collapsible container or bag. It should be appreciated that the phrase "collapsible container" can be used interchangeably with the phrase "collapsible bag" and is meant to include bags or containers having a side which needs to be lifted in order to push or place something therein. Exemplary collapsible bags include plastic bags such as those normally associated with packaging in the food industry, paper bags, storage bags, boxes needing a side lifted, and the like. In addition, the packager can provide for packaging in collapsible containers followed by packaging in non-collapsible containers such as rigid boxes. The stacks and non-stacks of articles can include the food and non-food items described above. Preferably, the articles are meat products such as meat patties, steaks, and the like, and other food products such as bread, pies, and the like.

The packager can include a packaging station for loading a stack of articles or a non-stacked article into a collapsible bag; collapsed container or bag at the packaging station; collapsible bag lifter for engaging and holding the top side of the collapsed bag, and which rises to provide an open bag; and plunger for pushing a stack of articles or a non-stacked article at the packaging station into the open bag. The bag can have a bottom side which is fixed in position at the packaging station and a top side which is free to move relative to the bottom side. The plunger can provide a pressure sufficient to detach the loaded collapsible bag product therein from the packaging station and the collapsible bag lifter.

Advantageously, the packaging apparatus can provide an open collapsible container, such as an open plastic bag, without utilizing pressurized air for inflating the collapsible container. The packager can additionally include a bucket for receiving a stack of articles or a non-stacked article and conveying it to the packaging station. Horn or horns can be provided for insertion into an open collapsible container to hold it open and define its dimensions, and the collapsible bag lifter can include suction cups attached to low pressure or vacuum hoses. In addition, a conveyor constructed and arranged to deliver or convey the articles to the packaging station can be provided. In addition, the packaging apparatus can be modified to package single stacks at one time or multiple stacks in single or multiple containers at one time.

A method for packaging stacked and non-stacked articles, including meat products, into collapsible containers is provided by the present invention. The method can include the steps of feeding stacked or non-stacked articles to a packaging station for loading into a collapsible container; opening a collapsible container at the packaging station; and placing the stacked or non-stacked articles in the open bag. The step of opening the collapsible container includes lowering a collapsible container lifter which attaches to the top side of the collapsible container, and lifting the top side of the collapsible container to provide an open container. The bottom side of the collapsible container being attached to the packaging station. Preferably, the collapsible container is a collapsible bag. In addition, the method can be practiced without injecting gas into the collapsible container to open it.

DETAILED DESCRIPTION OF THE INVENTION

Figure 1:
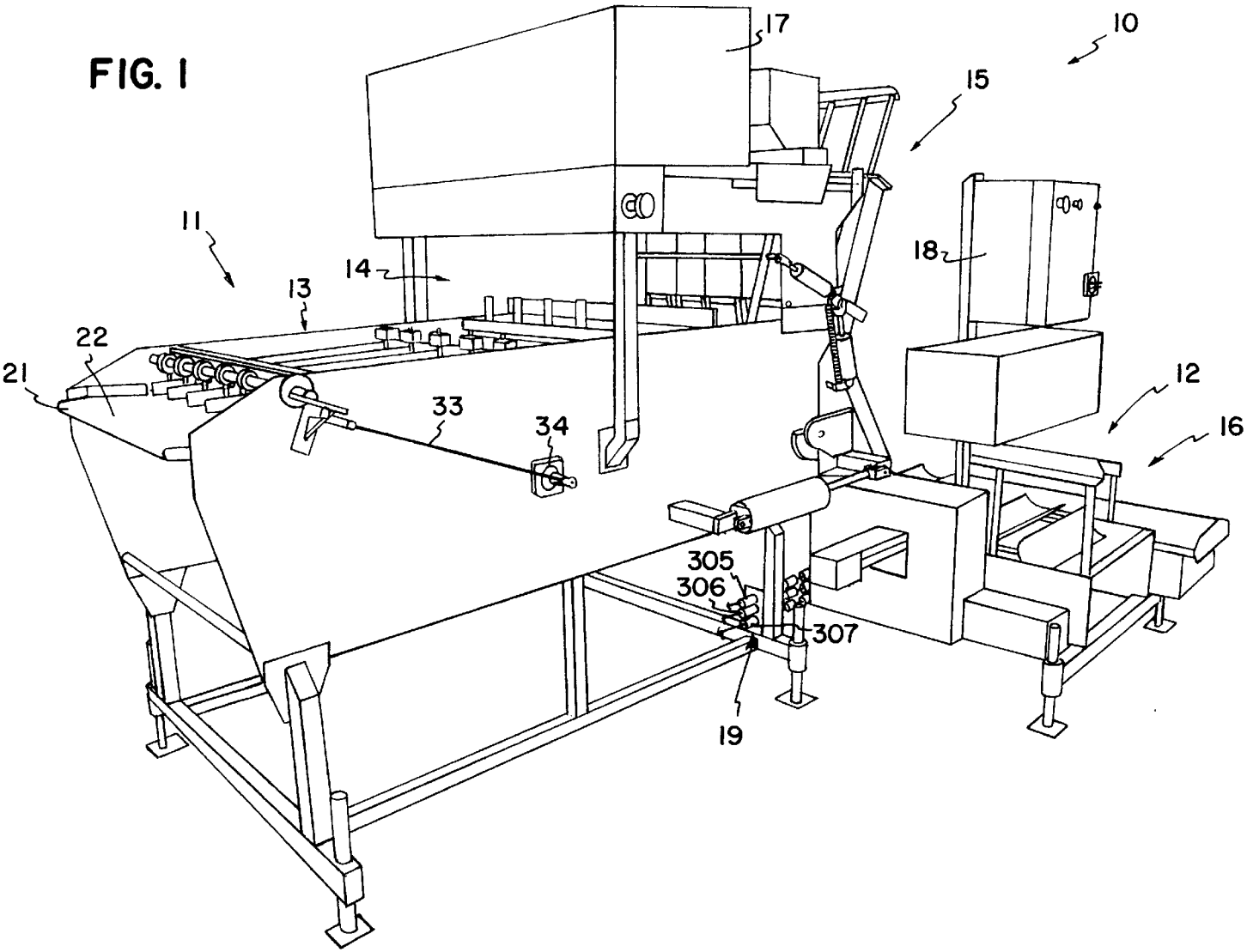
FIG. 1 is a perspective view of an apparatus for stacking and packaging frozen meat patties which embodies principles of the present invention.

The preferred embodiment of the invention will be described in detail with reference to the drawings, wherein like reference numerals represent like parts and assemblies throughout the several views. Reference to the preferred embodiment does not limit the scope of the invention, which is limited only by the scope of the claims attached hereto.

The reference numeral 10, FIG. 1, generally designates the apparatus for stacking and packaging meat patties according to the principles of the present invention. The apparatus for stacking and packaging meat patties 10 may be referred to herein as the patty stacking and packaging apparatus, and may be viewed as one apparatus which accepts individual meat patties and processes them into containers for shipment, or as an association of individual apparatus which act on meat patties to advance them to a stage where they can be shipped. Most conveniently, the apparatus for stacking and packaging meat patties 10 can be viewed as a combination of a stacking apparatus 11 and a packaging apparatus 12. For simplicity, the stacking apparatus 11 may herein be referred to as the patty stacking apparatus or the patty stacker. Similarly, the packaging apparatus 12 may herein be referred to as the stack packaging apparatus or the packager.

The stacking apparatus 11 and the packaging apparatus 12 can conveniently be attached so they can work together, or detached if is not desired to use both apparatus in combination. For example, it may be desirable to use only the stacking apparatus 11 to provide a stack of articles. Alternatively, it may be desirable to use the packaging apparatus 12 in packaging meat products which are not stacks of articles. If desired, the stacking apparatus 11 and the packaging apparatus 12 can be used individually or either can be used in combination with another machine. In addition, certain features of both apparatus can be isolated and used with or without the remaining features of the invention.

The patty stacking and packaging apparatus 10 is designed to be used in conjunction with patty forming machines, such as FORMAX brand patty forming machines. Of course, the apparatus can be modified, if necessary, to accommodate other patty forming machines. It is capable of stacking and packaging 18,000 patties per hour (300 patties per minute) in packages of 16 patties. The rate can be increased or decreased by altering various parameters which will become apparent from the following description. For example, the rate can be increased by increasing the number of patties in each stack, and the rate can be decreased by closing off certain lanes, slowing down the operation thereof, and/or reducing the number of patties in a stack. Preferably, the apparatus functions semi-continuously or intermittently which means that the rate of processing is controlled by the rate at which patties are fed thereto. The apparatus can be modified to include more lanes and thereby increase capacity.

As used herein, the reference to patties refers to frozen meat patties and, more particularly, to frozen hamburger patties. It is to be understood that the present invention can be practiced using articles other than meat patties. The article should have a rigidity or strength sufficient for it to resist undesired cracking or breaking during processing, and should have a shape which allows it to be processed. For being processed through the stacking apparatus 11, the article should be "relatively rigid and stackable." The phrase "relatively rigid" indicates that the article has sufficient rigidity to withstand fracture or unacceptable bending or folding pressures during stacking according to the principles of the present invention. More particularly, this can mean that at least half of the articles processed will not fracture, and more particularly, at least 95 percent of the articles processed will not fracture. Preferably, at least 99 percent of the articles processed will not fracture. For example, when hamburger patties are processed, it is generally desirable for the patties to be frozen or partially frozen so as to prevent deformation. In addition, the article should be "stackable" which means that several of the articles can form a stack in a column. The articles need not have a perfectly flat surface as long as they can be stacked. In fact, certain round or ball-shaped objects could be stacked by the principles of the present invention. In a preferred embodiment, however, the article is "substantially flat" which means that it has flat or relatively even surfaces which allows several articles to be stacked on each other without falling off. A preferred example of a stackable article is a hamburger patty. Furthermore, the article can have various configurations, such as, circular, oval, rectangular, triangular, spherical, cylindrical, etc., and the article can be food or non-food items. As will be readily apparent to one skilled in the art, other relatively rigid and stackable articles include, but are not limited to, cookies, crackers, cans such as tuna fish cans, automobile tires, books, sheets of metal or plywood, etc.

The articles which can be processed through the packaging apparatus 12 need not necessarily comply with the requirement for processing through the stacking apparatus 11. Although the packaging apparatus 12 can handle stacks of articles, there is no requirement that it only processes stacks of articles. The article should simply be capable of being pushed or driven into a bag. Exemplary articles which can be packaged via the packaging apparatus 12 include, stacks of patties, loaves of bread, cuts or pieces of meat, vegetables, heads of lettuce, etc. Non-food articles can similarly be packaged by the packaging apparatus. Such articles include books, cans, toys, etc.

It is to be understood that many of the materials used in construction of the apparatus for stacking and packaging meat patties 10 are preferably food grade materials. This means that the materials which contact the meat patties are acceptable for use in a machine which processes food, and can be conveniently and sufficiently cleansed using cleaning materials commonly used in the food industry. The materials which contact the patties in the present apparatus are primarily stainless steel and U.S.D.A. acceptable plastics. The electrical equipment used should be sufficiently insulated so as to minimize damage from the water and cleaning solution used to clean and disinfect the apparatus. Of course, if it is desired to process non-food material, it may be possible to use less expensive materials.

In the description which follows, reference is made to various components of the apparatus 10 moving between a work position and a home position. In the context of the following description, it is intended that the home position generally refers to the rest or idle position of that component, and that the work position generally refers to the position that the component achieves before returning to the home position. The work position can refer to the position where a component acts or performs some function it is provided to achieve. The identity of the home and work position for the components of the apparatus 10 will become apparent from the following description.

Again referring to FIG. 1, the patty stacking and packaging apparatus 10 has defined four general operational regions: a receiving, assorting or collating, and preliminary feeding region 13; a counting and stacking region 14; a transfer, delivery and dumping region 15; and a packaging region 16. The operations within each of the regions 13, 14, and 15 is controlled by the stacking controller 17, and the operations within region 16 is controlled by the packaging controller 18. The stacking controller 17 and the packaging controller 18 can communicate with each other via communicator 19 which allows the apparatus 10 to operate as a single unit. The communicator 19 is a readily separable link which conveys detectable signals. The phrase "readily separable" means that the stacking controller 17 and the packaging controller 18 can be separated from each other as will be discussed in detail. Separation may be advantageous if it is desired to use either the stacking apparatus 11 or the packaging apparatus 12 alone or in combination with other machinery. The communicator 19 can be provided with certain signals allowing the apparatus 11 and 12 to function. These signals will be discussed in more detail.

Sensors are provided throughout the patty stacking and packaging apparatus 10. These sensors detect the movement and location of certain components of the apparatus 10, and send signals to the controllers 17 and 18. Accordingly, the sensors allow the stacking controller 17 and the packaging controller 18 to control the operations and processing of frozen meat patties. It should be understood that sensors can be provided throughout the apparatus to indicate the position of components, for example, whether a component is in the work position or the home position. As will be apparent from the following description, a preferred program for the controllers which run the apparatus will include safety or precautionary instructions to prevent the apparatus from functioning until the components are in the proper position and the necessary sensors have been triggered.

In a preferred embodiment of the invention, many of the sensors which are described below are inductive proximity sensors which detect the presence of an object. Thus, when an object or part comes within a certain distance of a proximity sensor, a signal is provided by the sensor. Proximity sensors which are known to those of skill in the art can be used in the present invention.

The Receiving, Assorting or Collating, and Preliminary Feeding Region

Figure 2:
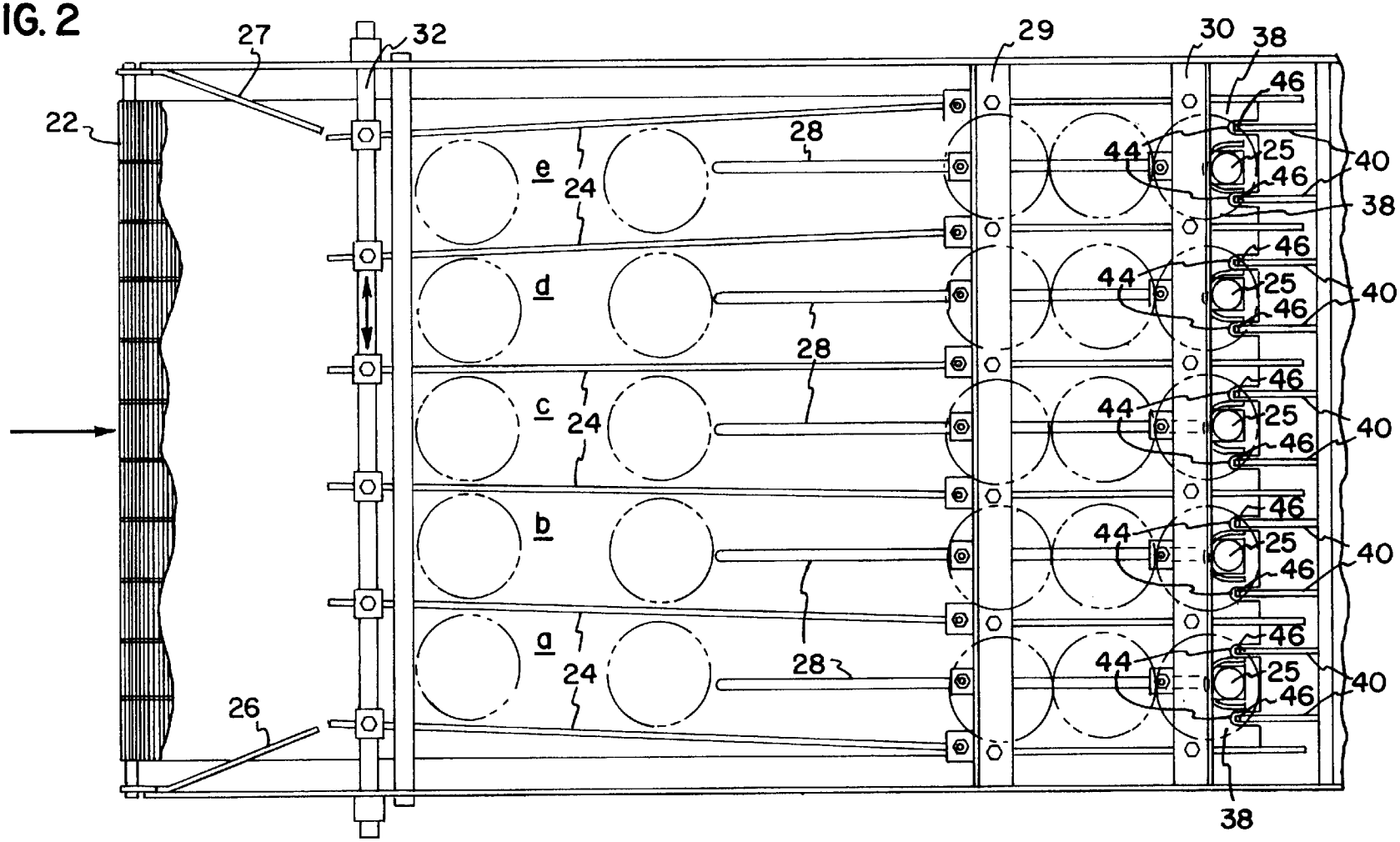
FIG. 2 is a top view of the receiving, assorting or collating, and preliminary feeding region of the apparatus shown in FIG. 1.

Now referring to FIG. 2, the receiving, assorting or collating, and preliminary feeding region 13 is shown in more detail where five separate lanes or streams (*a*)–(*e*) are provided for processing frozen meat patties. It should be kept in mind that the operations involved in each lane or stream generally occur in parallel, and that the equipment in each lane or stream often duplicates the equipment in other lanes or streams throughout the operation of the stacking apparatus 11. Thus, a component of the stacking apparatus 11 which may be common to more than one lane or stream will generally be referred to by a reference numeral. When it is necessary to identify a component or an operation in a particular lane or stream, however, the reference numeral will be followed by lane or stream designation (*a*)–(*e*). It will be understood that the following description of operations can occur in parallel in all the lanes or streams (*a*)–(*e*) through the regions 13, 14, and 15 unless indicated differently.

Referring now to FIGS. 2–18, consider the fate of frozen meat patties as they are processed through the meat patty stacking apparatus 10. Frozen meat patties flowing in the direction of the incoming product flow arrow are received on the in-feed conveyor 22 which urges the patties into the lanes (*a*)–(*e*) and toward the platforms 38 and the product brake plungers 25. The in-feed conveyor 22 is arranged as a continuous loop moving at a speed slightly faster than the horizontal speed the patties are delivered from a patty forming machine. This is intended to help provide a clean transfer of the patties onto the in-feed conveyor 22. The minimum speed of the in-feed conveyor 22 should be sufficient to handle or otherwise remove all patties delivered from the patty forming machine, and sufficient to urge the patties relatively evenly into the lanes (*a*)–(*e*) and thereafter into the counting and stacking region 14. Preferably, the in-feed conveyor 22 travels at a rate of about 150–175 ft./min. Since the patties are frozen or partially frozen, the in-feed conveyor 22 can travel faster than the speed of the patties without causing damage. It should be kept in mind that if other more sensitive articles are being processed by the apparatus, it may be desirable to operate the in-feed conveyor at a slower speed. If desired, the patties can have paper or a facing attached to one or both sides thereof when they are received onto the in-feed conveyor 22.

The patties in the receiving, assorting or collating, and preliminary feeding region 13 are preferably arranged as a single layer. This provides greater control over all the patties and more accurate counting of all the patties as they are processed. It is generally expected that the patties will be conveyed to the in-feed conveyor 22 from a patty forming machine. Accordingly, a small radius nose 21 is provided for clean transfer of patties from the patty forming machine onto the in-feed conveyor 22.

The lane dividers 24 are provided for dividing and separating the lanes (*a*)–(*e*). The lane guides 26 and 27 are used for directing the patties into the lanes (*a*)–(*e*) and to prevent the patties from getting trapped outside the lanes. As the patties are urged into the lanes (*a*)–(*e*) by the movement of the in-feed conveyor 22, they pass under vertically adjustable containment bars 28 which keep the patties as a single layer and prevents them from jumping out of the lanes or from stacking on each other. It is intended that the patties remain in a single layer until processed by the stacking or lifting step. Frame cross supports or angle irons 29 and 30 are provided to hold the lane dividers 24 and the containment bars 28 in place. The containment bars 28 can be adjusted in height over the in-feed conveyor 22 to provide a gap or clearance which allows patties of various thickness to be processed therethrough.

Shaker bar 32 is attached to the lane dividers 24 and provides a vibration to help prevent the patties from getting hung up or from sticking to each other or to the lane divider 24. Applicant has found that meat patties have a tendency to stick. The shaker bar 32 moves in the direction indicated by the arrow. The shaking also provides for a more even distribution of the patties into the lanes (*a*)–(*e*). The shaker bar 32 is connected to the motion transfer arm 33 which is connected to the eccentric 34. The motion transfer arm 33 is designed to transfer motion from one plane to another, namely, from a rotation in a vertical plane to a vibration in a horizontal plane. Since the lane dividers 24 are anchored to the angle iron 29, the shaking generally occurs in the upstream portion of the dividers 24.

The patties organized into columns in the lanes (*a*)–(*e*) are prevented from advancing through the apparatus 10 when the product brake plungers 25 are engaged. The product brake plungers 25 are operated by double acting pneumatic cylinders 31 which causes the product brake plungers 25 to actuate between a home or disengaged position and a work or engaged position.

Figure 3:
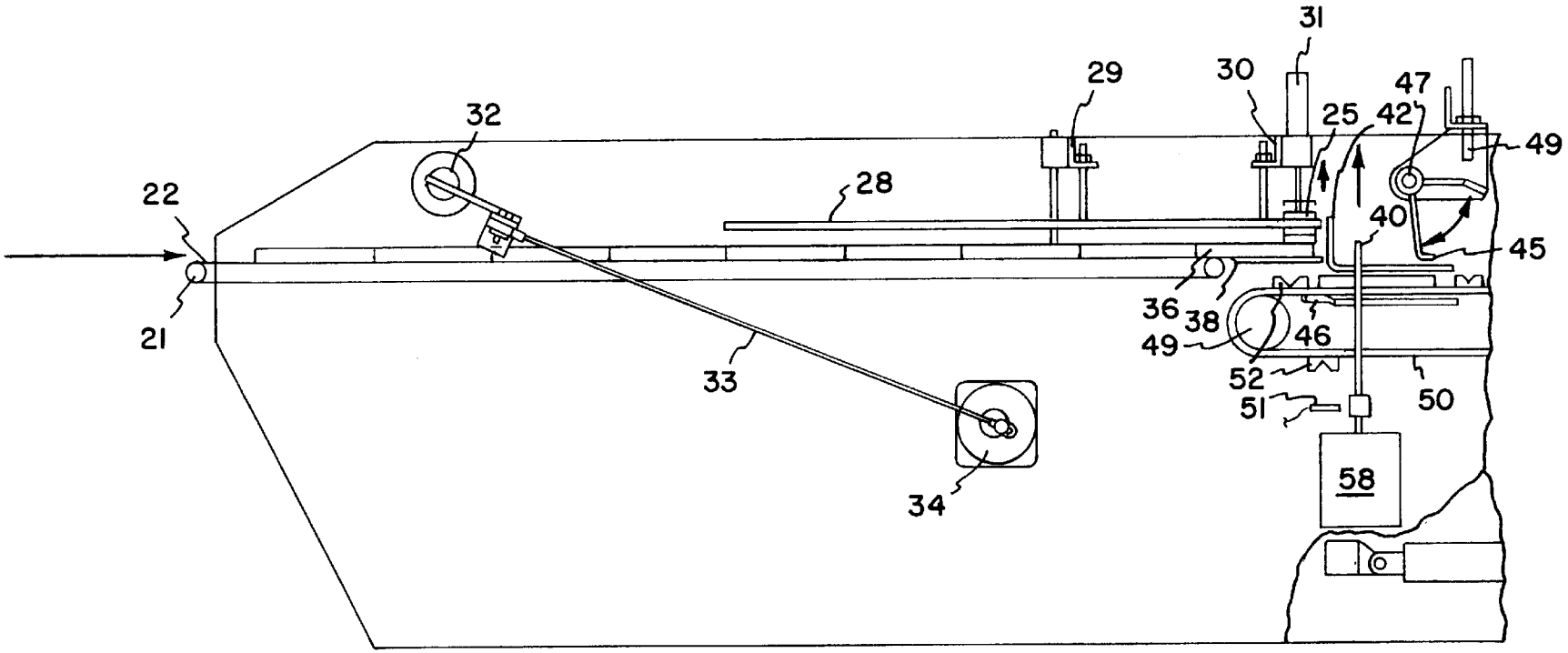
FIGS. 3–4 are diagrammatic, side views of the assorting or collating, and preliminary feeding region and the counting and stacking region of the apparatus for stacking frozen meat patties according to the principles of the present invention.

As shown in FIG. 3, product brake plunger 25 is shown in the work position where it engages and holds the patty 36 from advancing beyond the platform 38. When the product brake plunger 25 receives a signal that the counting and stacking region 14 is ready to receive product (patties), the product brake plunger 25 disengages the patty 36 by moving in the direction indicated by the arrow. The product brake plunger 25 is shown in the home or disengaged position in FIG. 4. In a preferred embodiment, all of product brake plungers 25 disengage at the same time along lanes (*a*)–(*e*) so that a patty from each lane advances into the counting and stacking region 14 at about the same time.

The Counting and Stacking Region

A row of patties enter the counting and stacking region 14 each time the product brake plungers 25 cycle from the work position to the home position. As a backup for product brake plunger 25 to hold the product (patty) in place while in the work position, the escapement 40 is provided with a retainer 42 which prevents the patties from advancing when the escapement 40 is in the work or down position shown in FIG. 3. Thus, when the escapement 40 cycles into home or up position shown in FIG. 4, it is in position to receive the patty 36 once the product brake plunger 25 cycles into the home position.

One advantage of the present invention is the ability to control the processing of patties throughout the apparatus by the action of the product brake plungers 25 (*a*)–(*e*). Until the stacking controller 17 is satisfied that the counting and stacking region 14 is ready to accept more patties, it will not allow the product brake plungers 25(*a*)–(*e*) to disengage the patties. As a result, all of the remaining steps in the counting and stacking region 14 can be halted until the product brake plungers 25(*a*)–(*e*) cycle into the home position and thereby release a row of patties.

As discussed above, in-feed conveyor 22 urges the patties onto the platform 38 where it is held in place by product brake plunger 25. It has been found that fatty tissue from the patties tends to build up on the platforms 38 during use which can cause patties to stick to the flat surface thereof. Accordingly, openings 44 are provided in the platforms 38 which allow lift rods 46 to elevate an edge of the patties slightly off the platforms 38 when escapement 40 cycles into the home position. The lift rods 46 are provided as part of the escapement 40. This lifting helps prevent the patties from sticking to the platforms 38 and allows the patties to easily flow into the escapement 40 when the product brake plunger 25 is disengaged.

Figure 4:
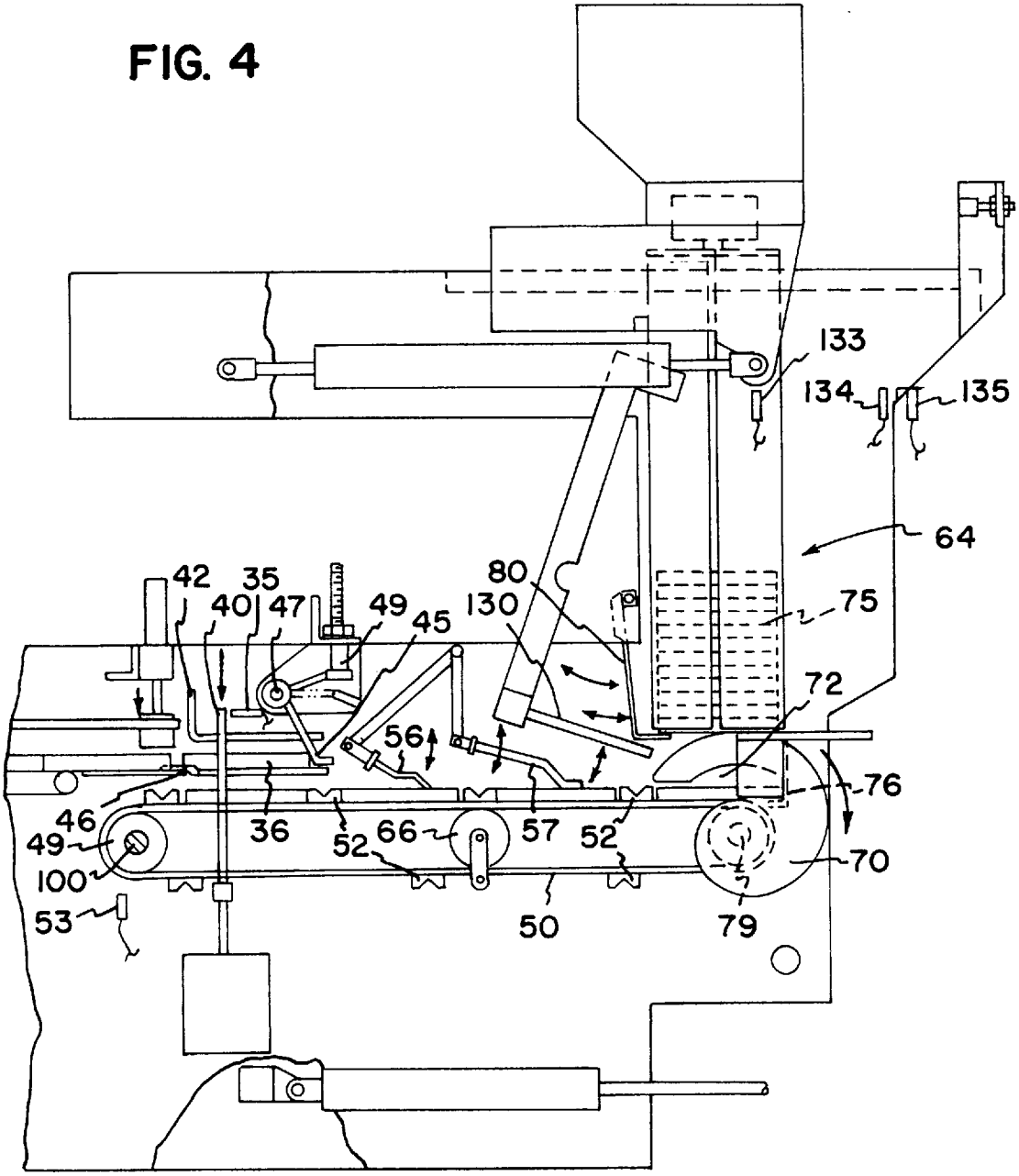

When provided with a signal, the product brake plunger 25 releases patty 36 which advances into the escapement 40 as shown in FIG. 4. As the patty enters the escapement 40, it displaces the trip switch 45 causing it to rotate about axis 47 and trigger the brake proximity sensor 49. Once the brake proximity sensors 49(*a*)–(*e*) are triggered, the product brake plunger 25 engages causing it to return to the work position to prevent further patties from advancing. The escapement 40 then cycles into the work position to deliver the patty 36 to the loading conveyor 50.

The pneumatic cylinder 58 causes the escapement 40 to cycle between the home and work positions. In the stacking apparatus 11, the escapement 40(*a*)–(*e*) are interconnected to provide one large assembly which is raised and lowered by the action of two pneumatic cylinders. If desired, the escapement in each lane can be separate and activated by individual pneumatic cylinders. It has been found that since patties are preferably processed (stacked) in parallel, it is desirable to have the escapement as one interconnected piece which is raised and lowered together since it reduces equipment cost and provides better timing.

The escapement proximity sensor 51 is triggered when the escapement 40 is in the work position. Another escapement proximity sensor 35 located on the side wall of the frame of the stacking apparatus 11 is provided to detect the escapement 40 in the home position.

When the escapement 40 is in the work position, the patty lowered thereby is provided on the loading conveyer 50. A dog 52 on the loading conveyor 50 engages the patty and advances it one station at a time toward the stacking cam 70. Thus, after the escapement 40 cycles from the home position to the work position, the loading conveyor drive wheel 49 rotates one revolution in the direction shown by the arrow in FIG. 4. As a result, the loading conveyor 50 advances a predetermined distance causing a dog 52 to engage the patty and move it out of the escapement 40 and into the first waiting station where it is held in place on the conveyor by the hold down assembly 56. It is pointed out that the loading conveyor 50 does not advance until it receives a signal to advance from the controller 17. Certain conditions can be satisfied before the controller 17 instructs the loading conveyor 50 to advance. Again, the loading conveyor 50 advances a predetermined distance causing the patty to move from the first waiting station to the second waiting station where it is held in place on the conveyor by the hold down assembly 57. The hold down assemblies 56 and 57 are bars heavy enough to prevent the patties from jumping up or off the conveyor 50. It has been found the abrupt movement of the conveyor 50 and the resulting force of the dogs 52 against the patties may cause the patties to jump if they are not contained. Again, the loading conveyor 50 advances a predetermined distance causing the patty to move from the second station into the stacking cam 70 where it is subsequently bottom stacked into the stacking column 64.

After the escapement 40 cycles into the work position and the loading conveyor 50 advances the predetermined distance to remove the patty from the escapement 40, the proximity sensor 53 is triggered by one full revolution of the loading conveyor drive wheel 49, and the pneumatic cylinder 58 engages causing the escapement 40 to cycle back to the home position where it waits to receive another patty. The proximity sensor 53 thereby detects when the loading conveyor drive wheel 49 is in the home position. One full revolution by the loading conveyor drive wheel 49 corresponds to the movement of the loading conveyor 50 the predetermined distance. Advantageously, the loading conveyor drive wheel 49 is provided with a circumference equivalent to the predetermined distance between stations. As would be apparent to one skilled in the art, the predetermined distance can be adjusted as desired by various techniques, including altering the circumference of the loading conveyor drive wheel.

It has been discovered that many prior stacking machines fail to adequately control the processing of each patty. As a result, it is not always possible to shut down the operation of the machine without subsequent movement of patties. It is an advantage of the present invention that control over each patty can be maintained at all times during the stacking operation. Thus, the escapement 40 provides for controlled movement of patties from the receiving, assorting or collating, and preliminary feeding region 13 onto the loading conveyor 50. The patties are then controlled while they are guided into the stacking cam 70 and, as will be described in more detail, are controlled in stacks until packaged.

Figure 5:
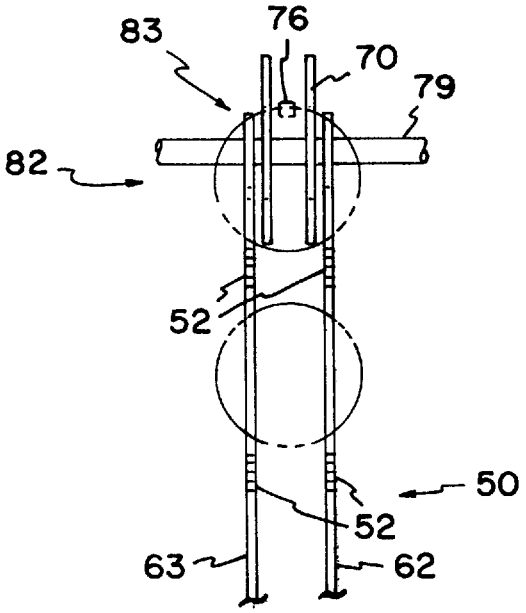
FIG. 5 is a diagrammatic top view of the counting and stacking region according to the principles of the present invention.

FIG. 5 shows a top view of the loading conveyor 50 guiding patties into the stacking cam 70. The area where stacking occurs can be referred to as the stacking station 82, and the apparatus used can be referred to as a bottom stacker 83.

The loading conveyor 50 includes dual index chains 62 and 63, each having dogs 52 attached thereto which guide the patties into the stacking cam 70. The dual index chains 62 and 63 run outside the stacking cam 70. This allows the stacking cam 70 to rotate without interfering with the operation of loading conveyor 50. The use of dual chains 62 and 63 is particularly advantageous when circular articles, such as circular meat patties, are conveyed. The dual chains help center the patties on the conveyor. Alternative arrangements could be provided, if desired. For example, a single index chain having dogs thereon could run through the center of stacking cam 70. However, in such an arrangement, it would be desirable to provide some type of guide to prevent the article being conveyed from falling off the conveyor. Possibly, side and bottom walls could be installed to keep the article on track. The tightener 66 is provided for taking up slack in the loading conveyor 50 and to provide additional support. Furthermore, it is noted that the dogs should be sturdy enough to convey the articles without bending or deforming when conveying certain heavy patties, and should be relatively light to minimize sagging by the loading conveyor. The shape of dogs 52 shown in FIG. 4 is provided to maximize strength and minimize weight. It has been found that light pins have a tendency to bend when used as dogs.

Each time the loading conveyor 50 moves the predetermined distance, one patty from the second waiting station for each active lane advances into the receiving area 72 of the stacking cam 70. The receiving area 72 may be referred to as a slot for receiving relatively rigid and stackable articles.

Figure 11:
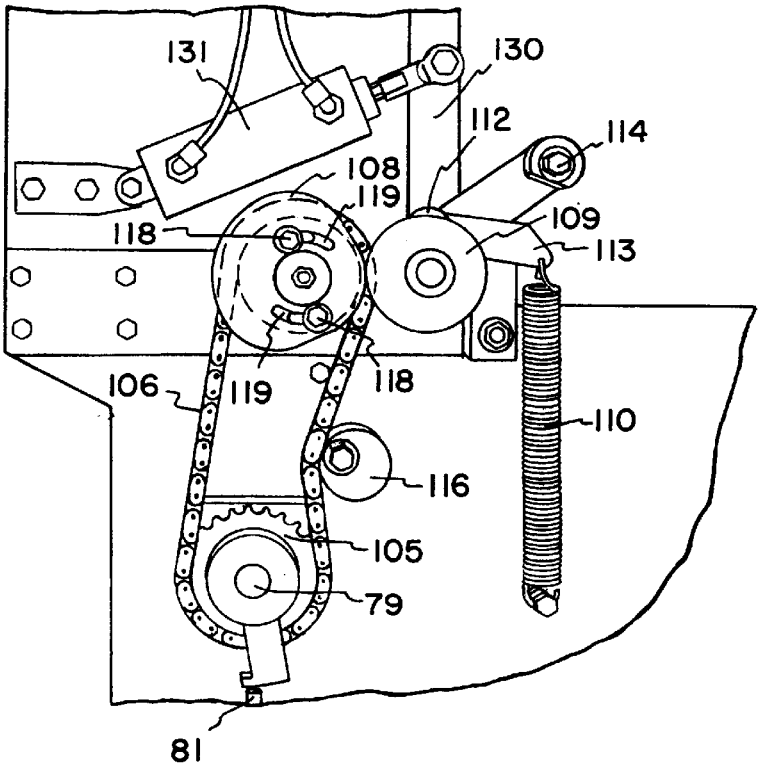
FIG. 11 is a side view of the counting and stacking region of the apparatus shown in FIG. 1, showing the relationship between the stacking cam shaft and the leveling finger.

In FIG. 4, the stacking cam 70 is shown in the home position where it can receive product. Once the loading conveyor 50 loads a patty into the receiving area 72, the stacking cam 70 rotates 360 degrees about the stacking cam shaft 79 in the direction of the arrow and returns to the home position where it waits until it again receives product in the receiving area 72. It is noted that the stacking cam 70 is securely attached to the stacking cam shaft 79. Each time the stacking cam 70 rotates, one patty is added to the bottom of the stack of patties 75 and the proximity sensor 81 shown in FIG. 11 is triggered sending a signal to the stacking controller 17 that one patty is stacked for each active lane.

During the 360 degree rotation of the stacking cam 70, the stationary disengagement wall 76 sweeps out the receiving area 72 and removes the patty (product) therefrom. The patty, which rests on the lifting surface 71 of the stacking cam 70, does not significantly move horizontally due to the presence of the stationary disengagement wall 76. The patty does rise vertically as the lifting surface 71 moves thereunder. The rotation of stacking cam 70 provides a bottom stacking of patties into the stacking column 64.

Figure 6:
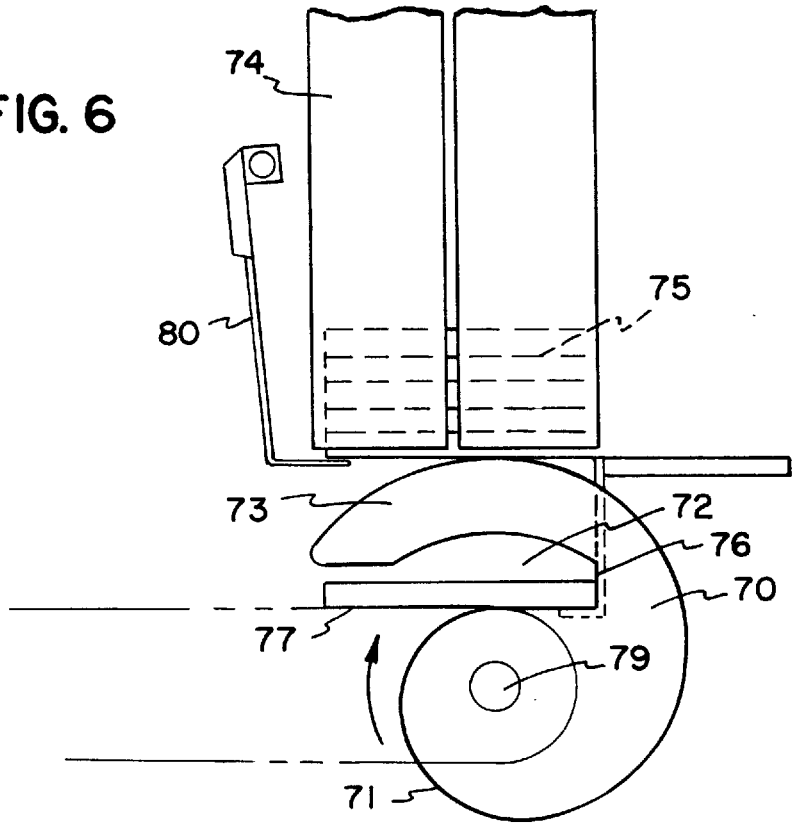
FIGS. 6–9 are diagrammatic, side views showing the operation of the stacking cam according to the principles of the present invention.

The operation of the stacking cam 70 is described in more detail in FIGS. 6–9, where the operation of the leveling finger 80 and the stationary disengagement wall 76 are demonstrated. In FIG. 6, the stacking cam 70 is in the home position and a patty 77 is loaded in the receiving area 72. The stacking cam 70 includes, as an integral part thereof, a protecting arm 73. The receiving area 72 being defined as the area between the lifting surface 71 and the protecting arm 73. As described herein, the lifting surface 71 includes, as an extension thereof, a receiving or resting surface where the patty sits, prior to rotation of the stacking cam and soon after rotation begins, even though no significant lifting may occur there. The leveling finger 80 is shown supporting one edge of the stack of patties 75. At this point, the stacking cam begins a 360 degree continuous rotation about axis 79.

Figure 7:
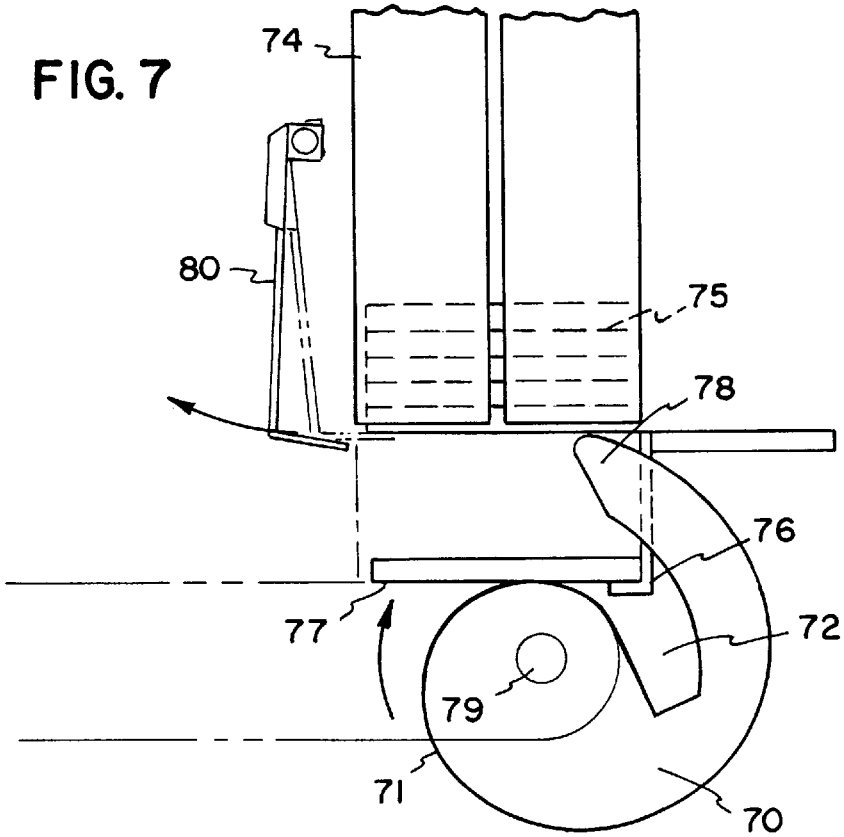

In FIG. 7, the stacking cam 70 is shown rotated about 95 degrees. The patty 77 is being forced out of the receiving area 72 by the presence of the stationary disengagement wall 76. The tip 78 of the stacking cam 70 supports one edge of the stack of patties 75 and the leveling finger 80 supports the other edge of the stack of patties 75. At this point, the leveling finger 80 and the tip 78 disengage the stack of patties 75 which causes the stack to fall evenly. If the leveling finger 80 and the tip 78 do not release simultaneously, it is generally more desirable to have the leveling finger 80 disengage first. This will help prevent the stack of patties from tilting too much before it falls on the patty 77. As will be described in more detail, the movement of the leveling finger 80 is mechanically timed to occur at precisely at the moment the tip 78 disengages the stack of patties 75 or slightly before the tip 78 disengages the stack of patties.

Figure 8:
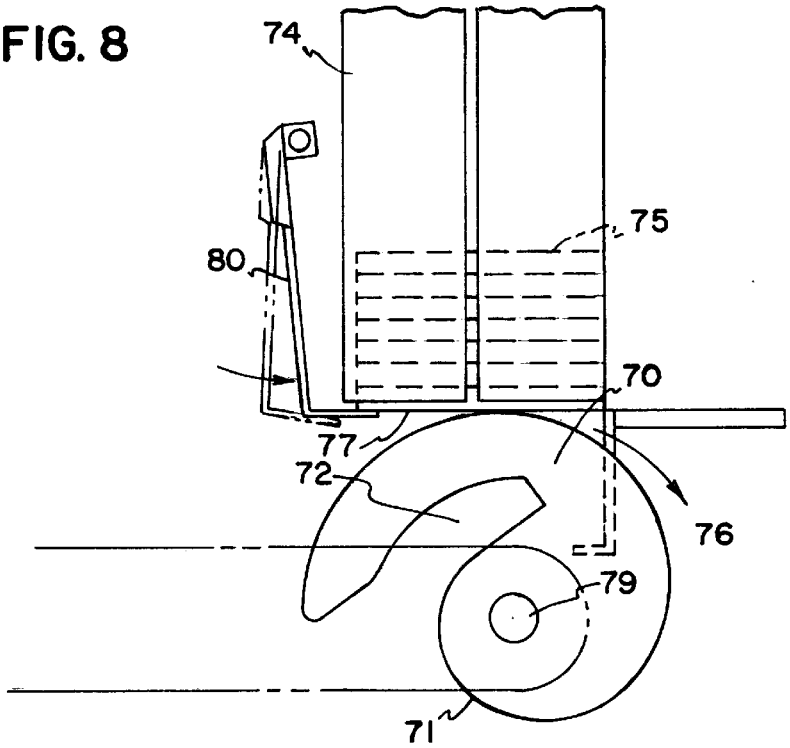

FIG. 8 shows the stacking cam 70 rotated about 180 degrees. At this point, the patty 77 has been completely unloaded from the receiving area 72 and is now the lowest member of the stack of patties 75. The stationary disengagement wall 76 keeps the stack of patties 75 aligned and resting on the lifting surface 71 of the stacking cam 70. If desired, the disengagement wall can be provided with a movement which helps raise the stack of patties. For example, the wall can lift with the stack and then lower before a new patty is loaded into the receiving area.

Figure 9:
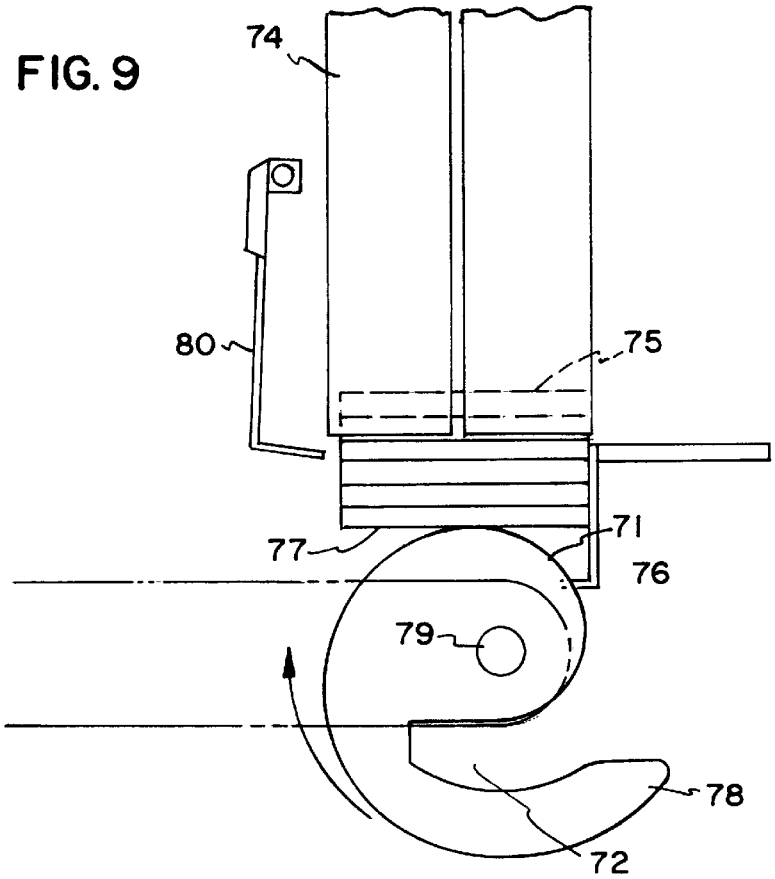

As the stacking cam 70 continues its rotation, the stack of patties 75 is lifted to a height shown in FIG. 9 where the leveling finger 80 swings back to support one edge of the stack of patties 75. By this process, a patty is added to the bottom of the stack of patties 75. It should be appreciated, however, that the stack of patties 75 can be provided in an arrangement other than the vertical arrangement shown in FIGS. 6–9. For example, the stack can be provided at a 45 degree angle from vertical so that the patties rest more on the disengagement wall. This arrangement could have an advantage in removing a need for the wall 74 in the stacking column 64.

As the stacking cam 70 rotates, the movement of lifting surface 71 across the lowest patty (at the bottom of the stack) provides a force that pushes the stack of patties away from the leveling finger 80. It has been found, however, that once the stacking cam 70 returns to the home position, the stack of patties tend to slide toward the leveling finger 80. Accordingly, the leveling finger 80 helps prevent the patties from sliding off the stacking cam 70 or, in other words, the leveling finger 80 helps prevent the patties from nosing down.

Each rotation of the stacking cam 70 triggers the sensor 81 proximity sensor 81 and sends a signal to the stacking controller 17 that one patty has been added to the stack. Each time the proximity sensor 81 is triggered, the stacking controller 17 is informed that the stacking cam 70 is in the home position.

The process steps from the disengagement of product brake plunger 25 to the revolution of stacking cam 70 are repeated until a predetermined number of patties are stacked in stacking column 64. Once the predetermined number of patties are stacked, a series of sequences are initiated causing the stack of patties to move into the transfer, delivery and dumping region 16, and eventually to the packaging apparatus 12.

The in-feed conveyor 22, the eccentric 34, the loading conveyor drive wheel 49, the stacking cam 70, and the leveling finger 80 can be driven by one motor. Advantageously, the use of a single motor allows the movements of the various components to be accurately timed relative to each other, and reduces the number of independent or separate motors needed to operate the stacking apparatus. For example, as will be discussed in more detail, by using a single energy source to power the actions of both the stacking cam 70 and the leveling finger 80, it is possible to mechanically time the movements thereof to occur a precisely desired moments. It is the timing of the movement of components, as it occurs throughout the apparatus as shown for various components, which allows the apparatus to function advantageously and provides control over the articles processed therethrough while maintaining a high rate of processing.

Figure 10:
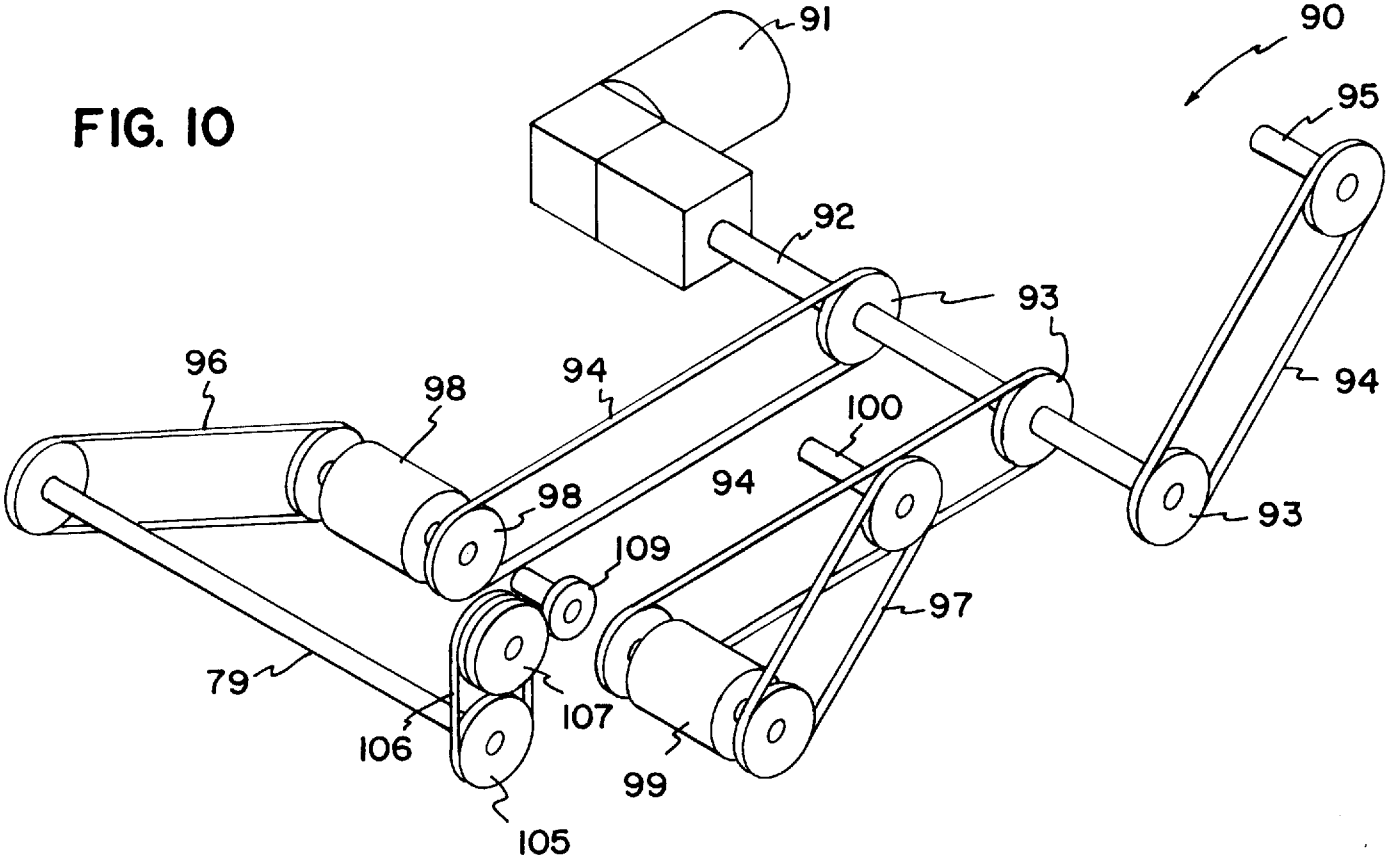
FIG. 10 is a perspective view of the drive train which drives the apparatus for stacking frozen meat patties according to the principles of the present invention.

As shown in FIG. 10, the right angle drive 91 drives the motor shaft 92 which in turn drives the sprockets 93 and the roller chains 94. Since the in-feed conveyor shaft 95 runs directly from the right angle drive 91, the in-feed conveyor 22 moves at a constant speed as the right angle drive 91 is engaged. As would be apparent to one skilled in the art, the speed of the conveyor shaft can be adjusted by changing the speed of the drive, by changing the size of the sprockets, or by providing gears. Roller chains 96 and 97 are connected to the right angle motor gear box 91 via one rotation clutches 98 and 99, respectively. When these clutches are provided with a signal, they engage allowing rotational energy created by the right angle drive 91 to drive the roller chains 96 and 97. After a predetermined degree of rotation, such as one revolution, these clutches automatically disengage thereby causing the roller chains 96 and 97 to cease moving. Many commercially available one rotation clutches presently on the market can be used to provide a predetermined rotation, including Hilliard Intermittent Drive Units. As will be appreciated from the following description, the clutches 98 and 99 can receive signals at different times from the controller 17 so they can act in concert.

The roller chain 96 drives the stacking cam shaft 79 which in turn drives both the stacking cam 70 and the leveling finger 80. As will be discussed in more detail, the movement of both the stacking cam 70 and the leveling finger 80 can be timed to occur at the precise moments shown in FIGS. 6–9. The roller chain 97 drives the loading conveyor shaft 100 which in turn drives the loading conveyor 50. Since the stacking cam 70 and the loading conveyor 50 are powered by the right angle drive 91 via the one rotation clutches 98 and 99, respectively, intermittent movement is provided.

The relationship between the rotation of the stacking cam shaft 79 and the leveling finger 80 is provided in more detail in FIG. 11. As the stacking cam shaft 79 rotates, it causes the sprocket 105 to rotate, which in turn causes the chain 106 to move and the sprocket 107 to rotate. The cam shaped wheel 108 is placed over the sprocket 107 and rotates as the sprocket 107 rotates. The follower wheel 109 is located and biased to move along the contours of the cam shaped wheel 108. The spring 110 provides tension on the lever 113 which pulls the follower wheel 109 and the leveling finger shaft 112 downward. The upper limit for movement of the lever 113 is provided by the stopper 114. Accordingly, the lever 113 moves according to a slight swinging action as the cam shaped wheel 108 rotates. As the cam shaped wheel 108 rotates, the follower wheel 109 moves along the contours thereof causing the leveling finger shaft 112 to swing as the lever 113 swings. Since the leveling finger shaft 112 runs through the stacking apparatus 11 and is connected to the leveling finger 80(*a*)–(*e*), the movement shown in FIGS. 7–9 can be provided. Thus, the leveling finger shaft 112 moves as a function of the movement of the follower wheel 109. As desired, the movement of the leveling finger 80 can be timed by adjusting the location of the cam shaped wheel 108 on the sprocket 107. The slots 119 and the bolt 118 are provided to make this adjustment. The idler tightener roller 116 is provided to take the slack out of the chain 106. As the chain wears, it may be necessary to adjust the roller 116.

The Transfer, Delivery And Dumping Region

Now referring to FIGS. 12–18, the operations involved in transferring the stack of patties 75 from the stacking column 64 to the packaging region 16 will be described in detail. The machinery which accomplishes this can be referred to as a stack mover.

Once the predetermined number of patties are stacked in the stacking column 64, the product brake plunger 25 is engaged to prevent further patties from entering the counting and stacking region 14. The leveling arm 130, shown in the home position in FIG. 4, then swings into the work position shown in FIG. 12. The leveling arm is caused to move by the action of pneumatic cylinder 131. A pneumatic cylinder is provided on each side of the stacking apparatus 11 and operates to move all the leveling arms 130(*a*)–(*e*) at the same time. Similar to the escapement, the leveling arms are interconnected so as to provide a concerted movement across all lanes. It has been found that the use of two pneumatic cylinders on the sides of the stacking apparatus is preferable to provide a smooth movement. Similar to the components of the invention, the action of the pneumatic cylinder 131 is controlled by the controller 17.

Figure 13:
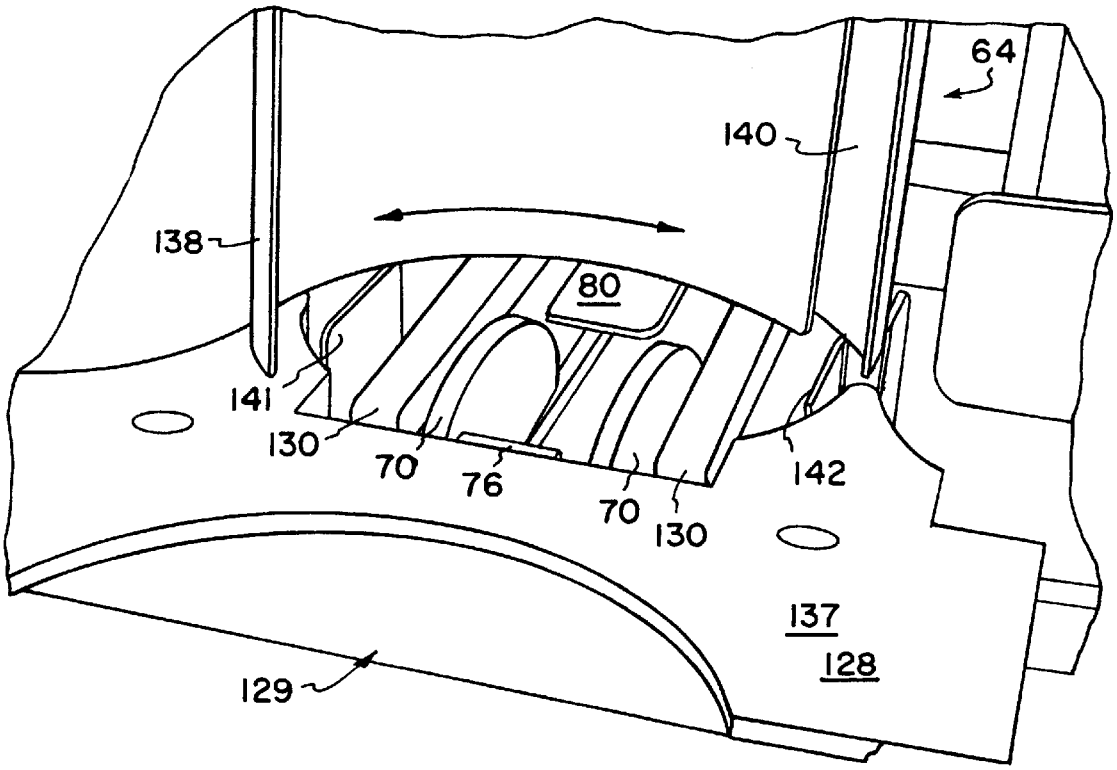
FIG. 13 is a perspective, rear view of the counting and stacking region of the apparatus shown in FIG. 1, showing the placement of the stacking column relative to the stacking cam.

The leveling arm 130, when in the work position, provides a level surface across which the stack of patties can slide. FIG. 13 is provided with the stack of patties removed and the rotating container wall 138 partly rotated in order to show the relationship between the stacking cam 70 in the home position, the leveling arm 130 in the work position, the leveling finger 80 in the home position, and the stationary disengagement wall 76. The adjustment wings 141 and 142 are provided and can be moved closer together or further apart to adjust for the size of the patties intended to be stacked. The adjustment wings help guide the patties into the stacking column 64.

The stacking column 64 is shown in the home position and is provided with non-rotating container wall 140 and rotating container wall 138 (partly rotated). As shown and as will be discussed in more detail, at the appropriate time during the operation of the stacking apparatus 11, the rotating container wall 138 rotates about the inside surface of non-rotating wall 140. Furthermore, the surface 128 is provided across which the stack of patties slides from the leveling arm 130 and onto the rotatable platform 156. The semi-circular opening 129 is provided into which fits the rotatable platform 156.

The stacking apparatus 11 can be adjusted to accommodate stacking a variety of size patties. The thickness of the patty is usually limited by the depth of the receiving area 72 of the stacking cam 70. Of course, however, the stacking cam can be modified to provide a larger receiving area. The diameter of the patty is usually limited by the diameter of the stacking column 64. Smaller diameter patties can be accommodated in the stacking column 64 by moving the adjustment wings 141 and 142 together to guide the patties therein.

Figure 14:
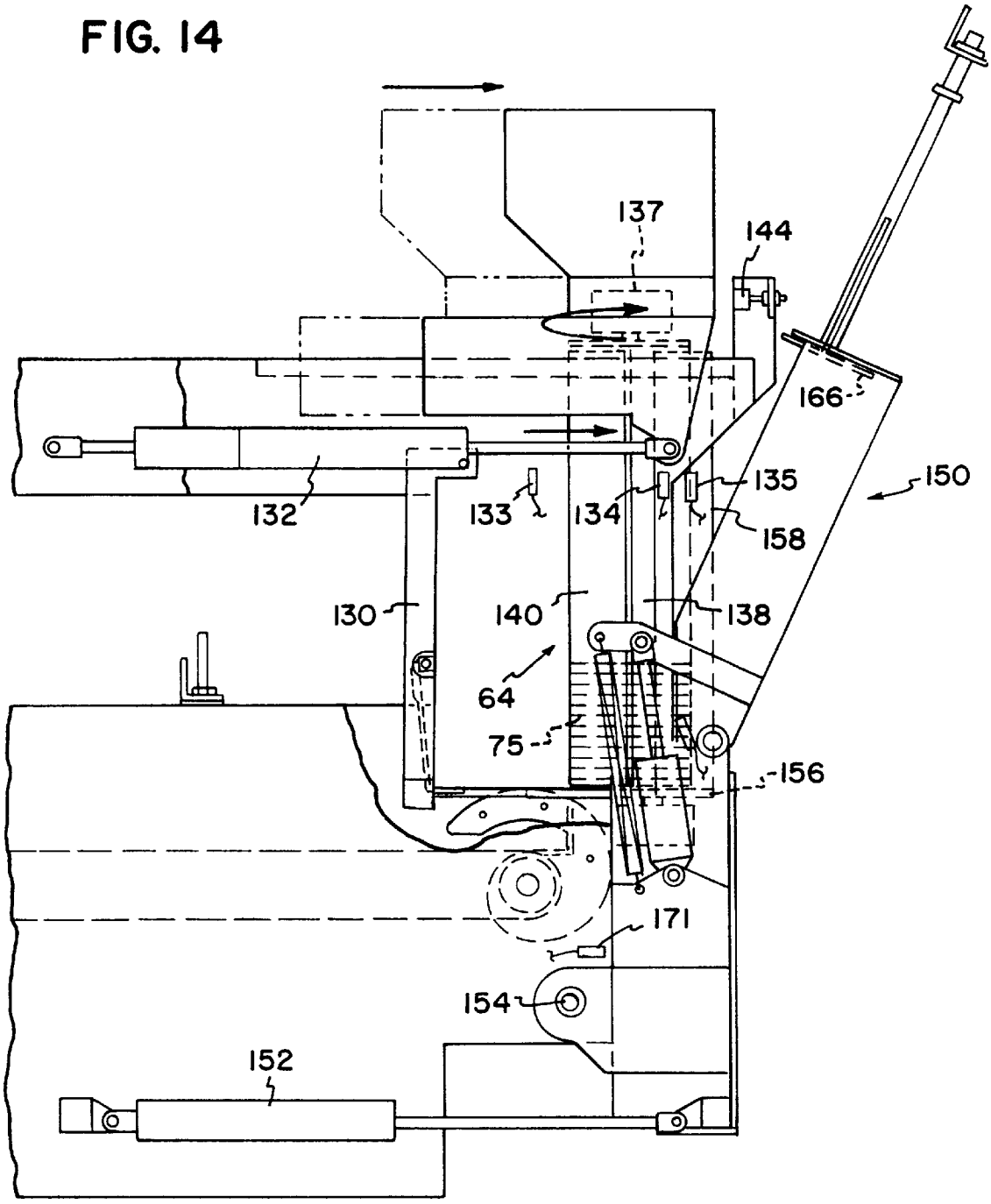

Once the leveling arm 130 is in the work position, the two stroke pneumatic piston 132 engages its first stroke and pushes the stacking column 64 a distance toward the dumper assembly 150. The distance pushed can be about 7 inches. The stack 75 thereby slides over the surface 128. FIG. 14 shows the first movement of the stacking column 64 triggering the proximity sensor 134. At this point, the rotation motor 137 is activated causing the rotating container wall 138 of the stacking column 64 to rotate, from the home position, about 180 degrees about the stack of patties 75 so that it becomes essentially nested inside the non-rotating container wall 140. After rotation, the rotating container wall 138 is in the work position. Sensors (not shown) are provided for detecting the rotating container wall 138 in the work and home positions.

Figure 15:
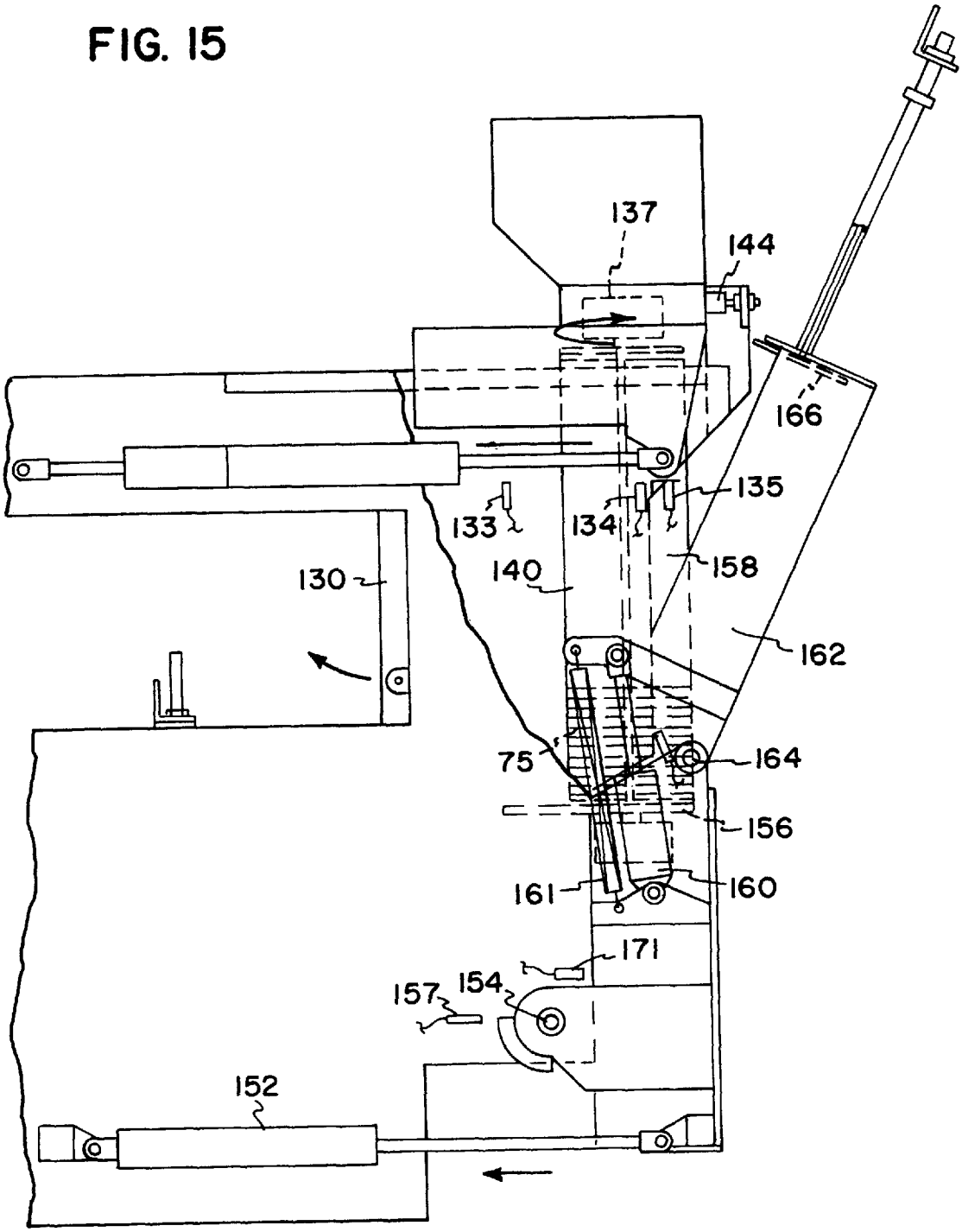

After the rotating container wall 138 rotates, the two stroke pneumatic piston 132 engages its second stroke and pushes the stacking column 64 the final distance so that the stack of patties 75 is loaded on the rotatable platform 156 and against the rotatable semi-cylinder 158 as shown in FIG. 15. As will be discussed, the rotatable platform 156 and the rotatable semi-cylinder 158 are attached and rotate together. The second stroke can push the stacking column 64 a distance of about one inch.

Once the stacking column 64 is pushed the full distance, the proximity sensor 135 is triggered telling the stacking controller 17 that the second stroke is complete. The adjustable stop 144 is provided to prevent the two stroke pneumatic piston 132 from pushing the stacking column 64 beyond its final position which could damage the dumper assembly 150. Triggering the proximity sensor 135 is an indication that the stack of patties 75 is loaded into the dumper assembly 150. At this time, the two stroke pneumatic piston 132 and the pneumatic piston 152 begin retracting as shown by the arrows in FIG. 15.

The retraction of the two stroke pneumatic piston 132 causes the stacking column 64 to move back to its home position shown in FIG. 4. As the stacking column 64 is returning to its home position, the rotating container wall 138 rotates back into its home position, and the pneumatic piston 131 engages causing the leveling arm 130 to move back to its home position. The arrows provided in FIG. 15 show these movements. Preferably, the rotating wall 138 is fully rotated into its home position and the leveling arm 130 has returned to its home position by the time the two stroke pneumatic piston 132 is fully retracted in order to minimize delay in resuming stacking.

Once the stacking column 64 is returned to its home position, the proximity sensor 133 is triggered telling the stacking controller 17 that the stacking column 64 is in position to accept product. Once the rotating wall 138 is rotated into its home position, a proximity sensor (not shown) is triggered telling the stacking controller 17 that the stacking column 64 is ready to accept product. A further proximity sensor (not shown) is provided for indicating that the leveling arm 130 is in its home position. Once all these conditions are satisfied, the stacking process can be repeated until a predetermined or desired number of patties are stacked in the stacking column 64.

Figure 16:
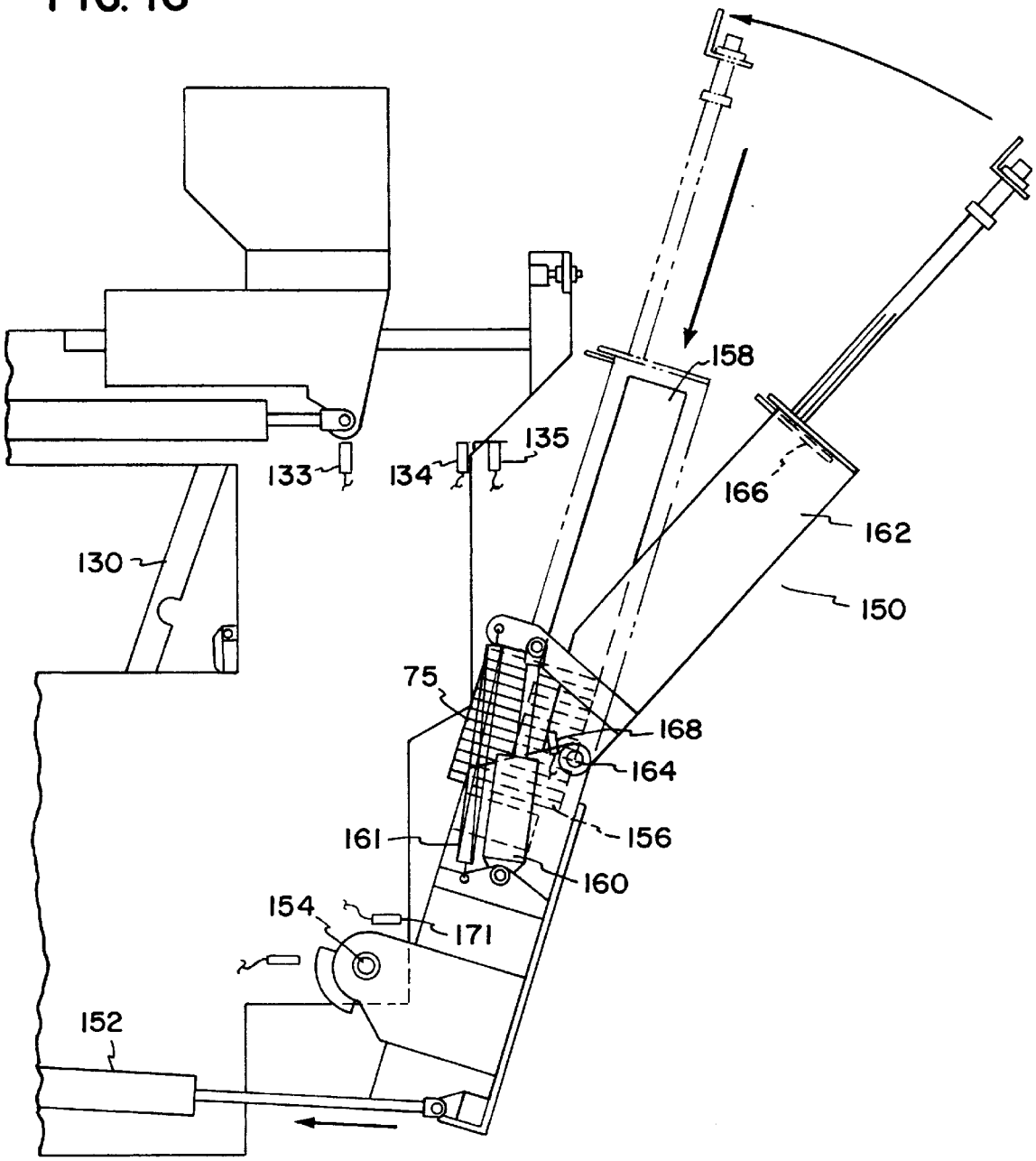
Figure 17:
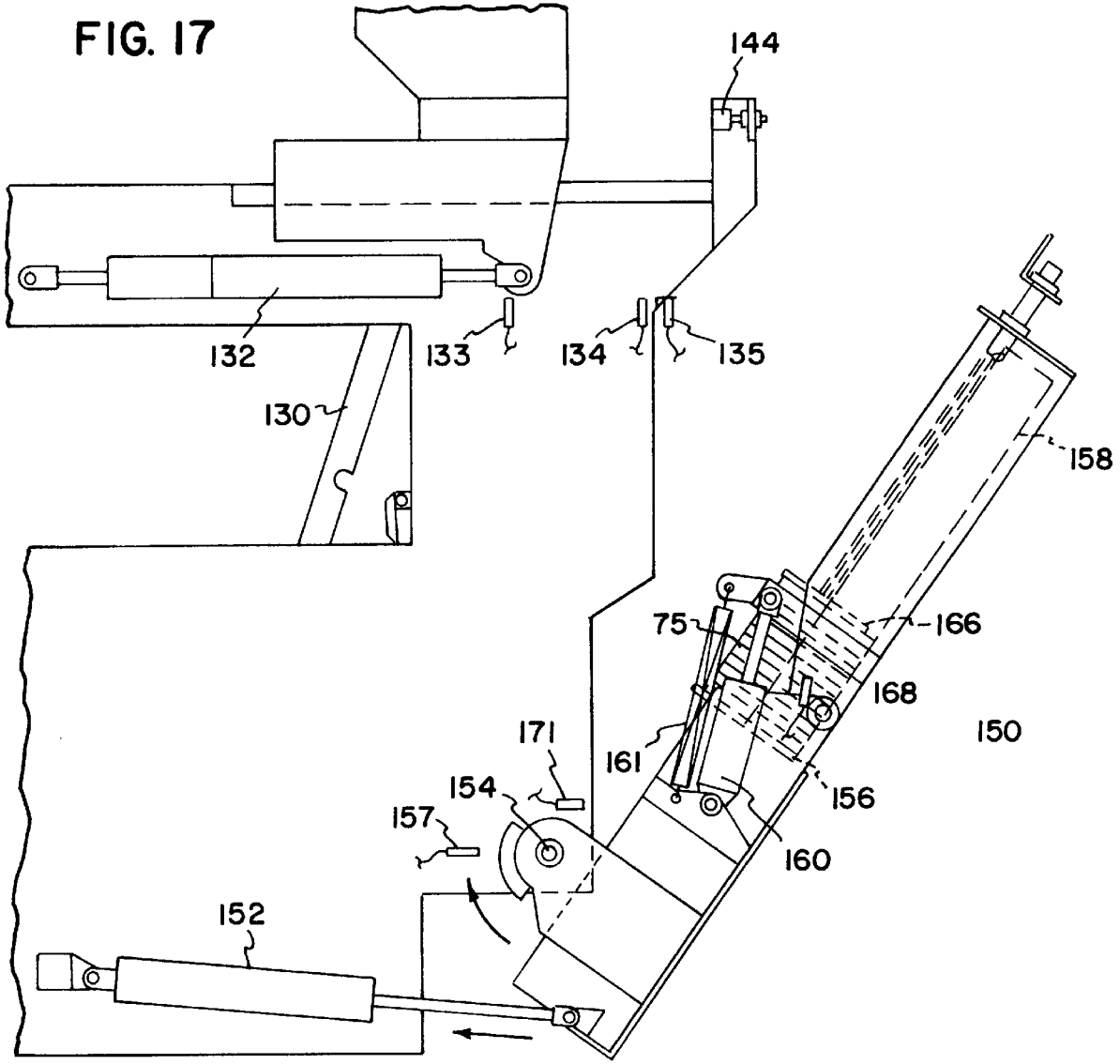
Figure 18:
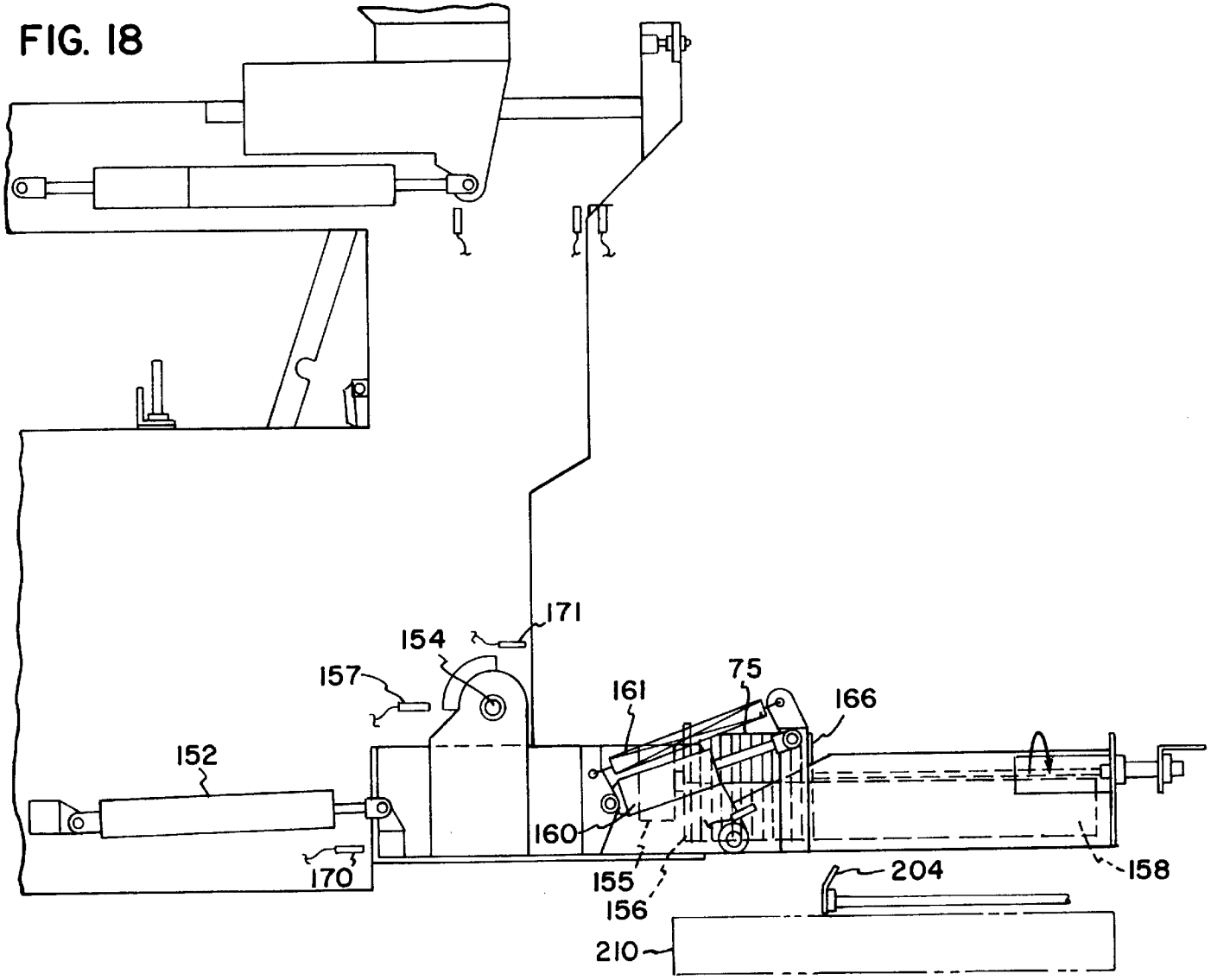

As discussed above, once the proximity sensor 135 is triggered, the pneumatic piston 152 begins retracting causing movement of the dumper assembly 150. At this point, the stack of patties 75 rests on the rotatable platform 156. As shown in FIG. 16, the pneumatic piston 152 causes the dumper assembly 150 to rotate or pivot about the axis 154. This causes the dumper assembly 150 to begin its movement from the home position, through an arcuate path, toward the work or horizontal position which is shown in FIG. 18. It is noted, however, that the dumper assembly 150 can be arranged to provide a different path between its work and home positions.

Soon after the dumper assembly 150 begins rotating about the axis 154, once it rotates about 15 degrees, the proximity sensor 157 is triggered causing the pneumatic cylinder 160 to retract so that the plunger casing 162 pivots about the axis 164 as shown by the top arrow in FIG. 16. The assist spring 161 helps the pneumatic cylinder 160. If desired, one cylinder can be used in place of the assist spring 161 and the pneumatic cylinder 160.

The plunger casing. 162 is provided so that the plunger 166 can engage the stack of patties 75 to keep the patties in a stack as they are lowered to a horizontal position. Once the plunger casing 162 moves into a position around or coplaner with the rotatable semi-cylinder 158, the plunger 166 descends onto the stack of patties 75. The movement of the plunger casing 162 followed by the movement of the plunger 166 as shown by the arrows in FIG. 16. It should be appreciated that it may be possible to avoid the use of the rotatable semi-cylinder if the plunger can sufficiently hold the stack until it is delivered.

The movement of the plunger 166 engaging the stack of patties 75 is caused by cylinders (not shown) on the sides of the plunger casing 162. When provided with a signal, the cylinders cause the plungers on all the lanes to engage simultaneously. A plunger guide 163 is provided on both sides of the plunger casing to guide the plunger 166 (see FIG. 12). Once the plunger casing 162 completes its rotation and is in the work position shown in FIG. 17, the proximity sensor 168 is triggered.

The pneumatic cylinder 152 continues retracting as the plunger casing 162 and the plunger 166 complete their movement. Accordingly, the dumper assembly 150 continues rotating through the position shown in FIG. 17 and into the work position shown in FIG. 18 thereby triggering the proximity sensor 170. When provided with a signal from the stacking controller 17, the rotation motor 155 is engaged causing the rotatable platform 156 and the rotatable semi-cylinder 158 to rotate about 180 degrees into the work position. Proximity detectors (not shown) are provided for detecting and reporting the position of the rotatable semi-cylinder 158. As the rotatable semi-cylinder 158 rotates, the stack of patties 75 is released from the dumper assembly into the bucket 210 which forms a part of the packaging region 16. The bucket 210 can be a semi-cylinder, a trough-shape container, or other suitable arrangement for receiving and moving a stack of patties. Accordingly, buckets 210 are provided for receiving stacks from each lane (*a*)–(*e*).

Once the stack of patties 75 falls into the bucket 210, the pneumatic piston 152 engages causing the dumper assembly 150 to return to the home position shown in FIG. 15. As the dumper assembly 150 returns to its home position, the rotation motor 155 is engaged causing the rotatable platform 156 and the rotatable semi-cylinder 158 to rotate back to their home position, the plunger 166 moves to its home position, and the pneumatic cylinder 160 engages causing the plunger casing 162 to return to its home position. Once the proximity sensor 171 is triggered, the dumper assembly 150 is fully back to its home position and is ready to receive another load of stacked product.

Each lane or stream in the dumper assembly 150 is provided with a separate rotating motor 155(*a*)–(*e*) electrically connected to the stacking controller 17. As desired, the stacks from all lanes can be released simultaneously, individually, or in some combination. By controlling the release of stacks from individual lanes, the packaging can be controlled as discussed below.

The Packaging Region

Once the stacks of patties are released into the buckets 210, they are ready to be placed into collapsible containers, such as bags. It should be kept in mind that the processing capacity of the packaging apparatus 12 should be sufficient to handle the stacks of patties as they are received from the stacking apparatus 11. It has been found that the packaging apparatus 12 can generally handle the maximum capacity of the stacking apparatus 11 when two stacks are bagged simultaneously. Thus, when the packaging apparatus 12 is used in combination with the stacking apparatus 11, it is generally desirable to use either the two stack bagger 205 shown in FIGS. 19 and 20 for packaging two stacks per bag or the dual one stack bagger 208 shown in FIG. 21 for packaging one stack per bag. Although a double bagger and a single bagger are described in detail herein, it should be kept in mind that the present invention includes a packaging apparatus which can be adjusted in numerous ways without departing from the spirit of the present invention.

Since the packaging controller 18 primarily controls the operation of the packaging apparatus 12, it is preferably programmed to handle the packaging of stacks as they are dumped into the buckets 210. As discussed above, the stacking controller 17 and the packaging controller 18 can communicate with each other via the communicator 19. This allows the two controllers to identify when and how the stacks of patties are transferred from the stacking apparatus 11 to the packaging apparatus 12. In addition, this communication provides enhanced control over the processing of the patties and provides for the cessation of operations when a breakdown or some other particular event occurs. Advantageously, the packaging controller 18 can prevent the stacking apparatus 11 from supplying stacks to the packaging apparatus 12 at a rate greater than they can be packaged.

In a preferred embodiment, the packaging apparatus 12 can easily be adjusted for packaging two stacks in a single bag or one stack in a single bag, and will accommodate the flow of stacks from the stacking apparatus 11. When the stacking apparatus 11 is working at full capacity, five lanes of stacks are dumped into five buckets 210. The stacking apparatus 11, however, may release less than all five lanes of stacks. Bucket sensors 206 are provided to detect the presence of stacks in the buckets 210. The information is conveyed to the packaging controller 18 where it is processed to determine the operation for packaging the stacks located in the buckets 210.

Figure 20:
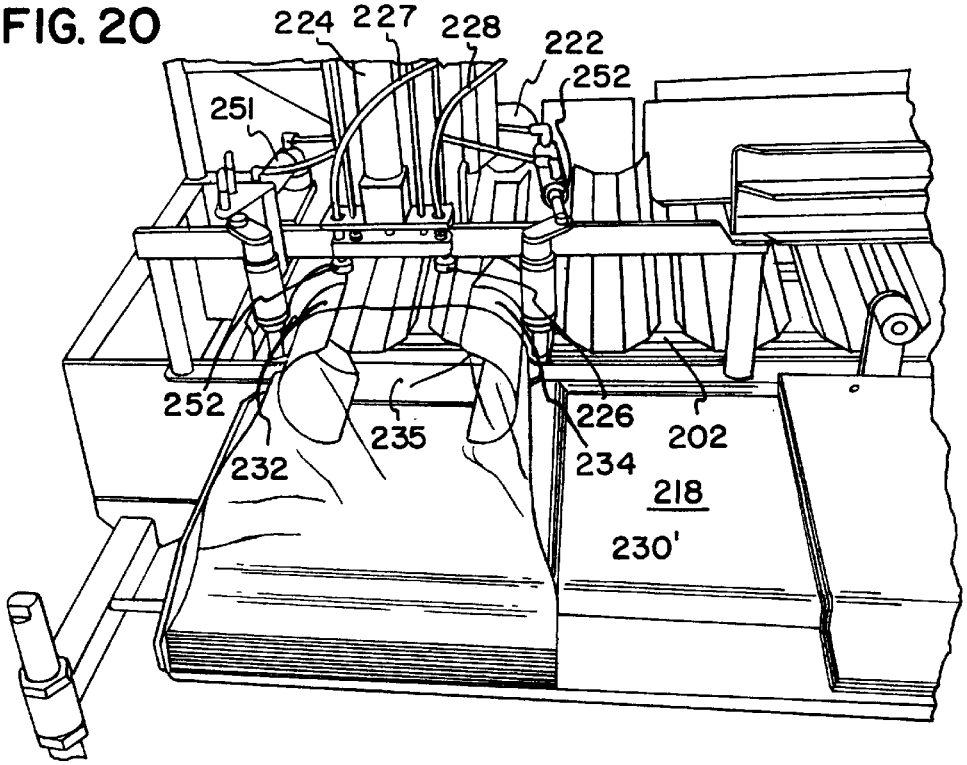
FIG. 20 is a perspective view of the packaging apparatus shown in FIG. 19 after a bag has been opened.
Figure 12:
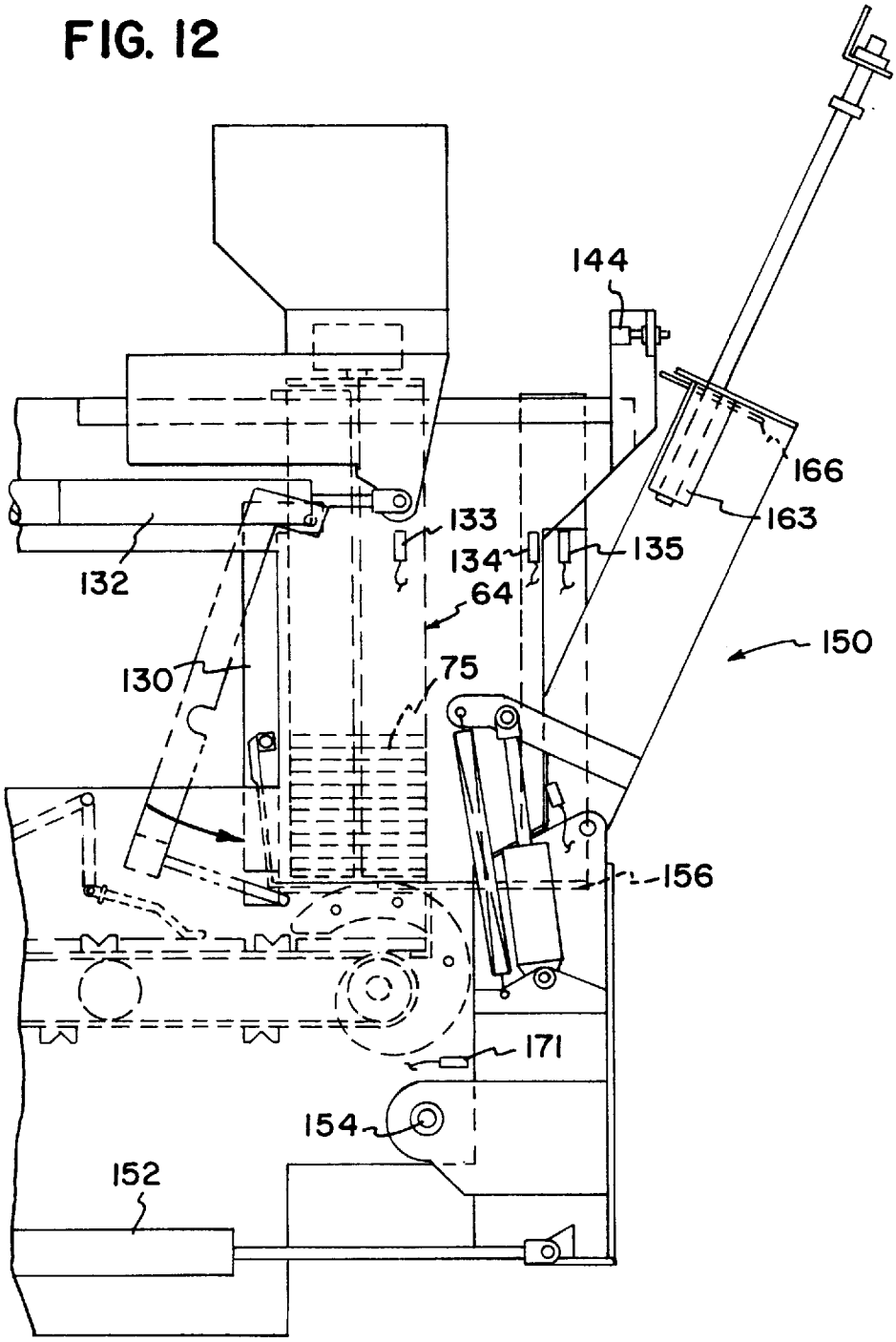
FIGS. 12 and 14–18 are diagrammatic, side views of the counting and stacking region and the transfer, delivery and dumping region of the apparatus for stacking frozen meat patties according to the principles of the present invention.
Figure 19:
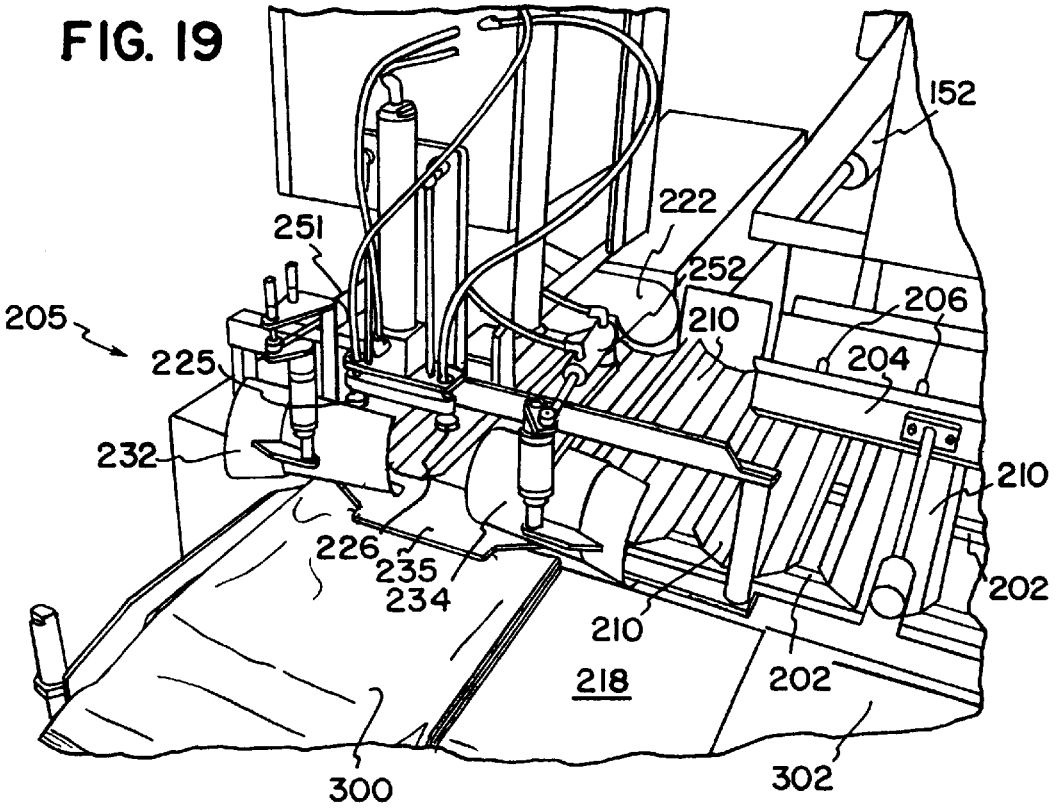
FIG. 19 is a perspective view of the packaging apparatus according to the principles of the present invention.

Now referring to FIGS. 19 and 20 where the packaging apparatus 12 is shown in detail using the two stack bagger 205. The buckets 210 are arranged as part of a circular conveyor 202 which moves the buckets 210 toward packaging station 220 and then circle underneath and back as a continuous loop. As discussed above, the dumper assembly 150 dumps or deposits stacks of patties into the buckets 210. When functioning at full capacity and using the two stack bagger 205, the stacks from lanes (*a*)–(*e*) of the stacking apparatus 11 are dumped simultaneously into five waiting buckets. As will be discussed below, it may be desirable at times not to dump all of the stacks at once. It is noted that at the right side of FIG. 19, only two of the five buckets in position to receive stacks are shown.

The circular conveyor 202 moves the loaded buckets toward the packaging station 220. The movement of the circular conveyor 202 stops as the stacks are loaded into the buckets and during moments when the stacks are packaged. The adjustable retainer wall 204 holds the stacks of patties together in the buckets 210 and can be adjusted to provide for larger or smaller stacks. Thus, if the stack height is increased, the adjustable retainer wall 204 can be moved outward to allow the larger size stack to fall completely into the bucket 210. As an alternative to the use of the adjustable retainer wall 204, or as an embodiment which can be used in combination therewith, the buckets 210 may be tilted at an angle beyond level to discourage the patties at the ends of the stack from falling over in the bucket. The angle may, for example, be 30 degrees from horizontal.

As the stacks drop into the buckets 210, the bucket sensors 206 are triggered in the particular buckets containing stacks. A bucket sensor which can be used is a diffuse reflective type photoelectric sensor or photo-eye preferably having a NEMA 4× rating which are commercially available and resistant to washing. It is pointed out that the bucket sensors detect presence and need not be used for counting. The packaging controller 18 is thereby informed of the particular buckets containing a stack for bagging, and can thereby adjust the movement of the circular conveyor 202 to accommodate the stacks present in particular buckets. This is important, for example, when there are five lanes in operation in the stacking apparatus 11 and the stacks are being bagged two at a time. In this situation, it is important that the fifth stack not advance to the packaging region 220 until another stack is placed in an adjacent bucket. Thus, the stacking controller 18 must inform the circular conveyor 202 to cease movement until a stack is dropped in an adjacent bucket.

Once buckets 210 containing stacks to be packaged enter the packaging station 220, a plunger 222 pushes the stack of patties located in the two adjacent buckets into an open plastic bag 230'. Generally the plunger 222 forces the patties into the open bag 230' with such a force that the bag is pushed off the bag loading platform 218. If desired, the loaded bags can be pushed off the loading platform 218 and into boxes or cartons.

The plastic bags are opened at the packaging station 220 by a series of actions. When the plastic bag 230 is collapsed as shown in FIG. 19, the bag opening pneumatic cylinder 224 engages causing the suction cups 225 and 226 to engage the exposed outer surface of the collapsed plastic bag 230 whereby the vacuum lines 227 and 228 create a suction on the plastic bag 230. The bag opening pneumatic cylinder 224 then retracts lifting the exposed outer surface of the plastic bag 230. The slide plate 235 covers the inner bottom surface of the plastic bag 230 and is provided to allow the stack of patties to slide thereover and into the bag. Once the exposed outer surface of the plastic bag 230 is raised (and the bottom surface is under the slide plate 235), the horns 232 and 234 swing into the lifted plastic bag 230 to provide the fully opened plastic bag 230' having the dimensions shown in FIG. 20. The open plastic bag 230' is ready to receive the stacks of patties, and plunger 222 is engaged causing the stacks to load into the opened plastic bag 230'.

The plastic bags 230 are preferably provided in a pre-stapled stack which can be conveniently loaded onto the bag loading platform 218. In these stacks, the upper or top portion of the collapsed bags should be free to move so they can be lifted to form open bags. Accordingly, only the bottom portion of the bag should be held in place. The pneumatic cylinders 251 and 252 cause the horns 232 and 234, respectively, to swing between the home position shown in FIG. 19 and the work position shown in FIG. 20.

Figure 21:
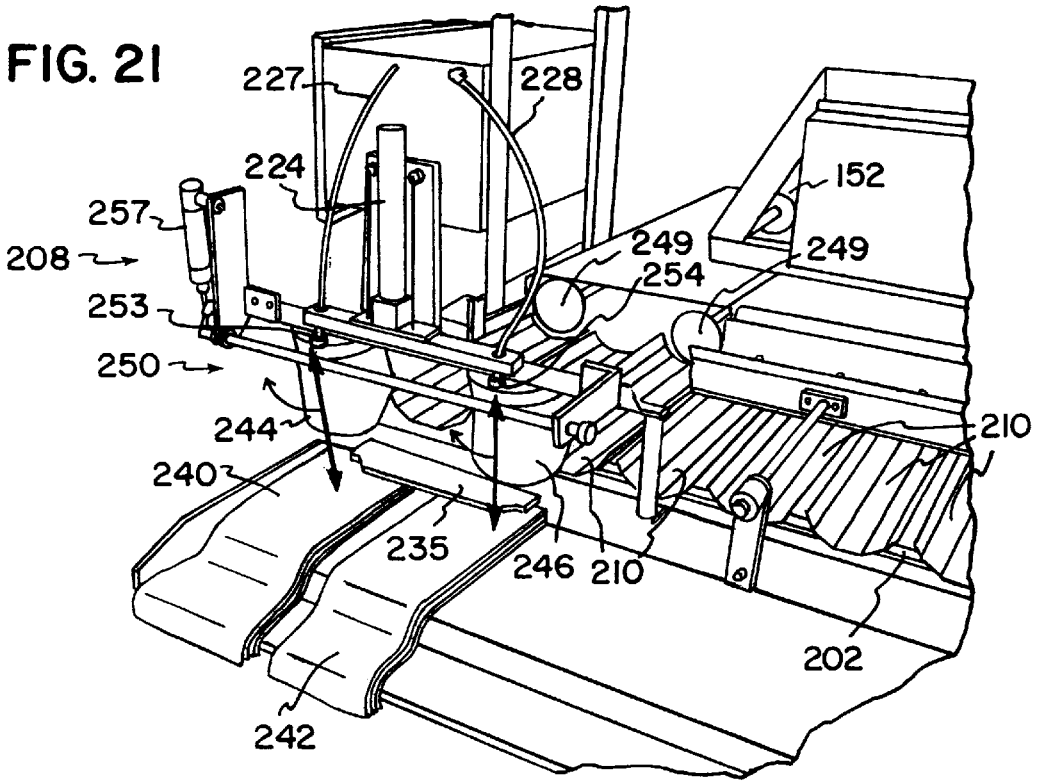
FIG. 21 is a perspective view of an alternative embodiment of the packaging apparatus according to the principles of the present invention, arranged to package in single stack bags.

In an alternative embodiment of the invention, shown in FIG. 21, the patties can be loaded into single container bags 240 and 242. The principles of operation of this alternative embodiment are similar to that described above for the embodiment shown in FIGS. 19 and 20. In particular, once buckets containing stacks enter the packaging station 220, a plunger 249 pushes the stacks of patties located in two non-adjacent buckets into open plastic bags. The plunger 222 for pushing the adjacent stacks can be replaced with plunger 249 for pushing non-adjacent stacks. The plastic bags 240 and 242 are opened at the packaging station 220 by a series of actions. When the plastic bags 240 and 242 are collapsed as shown in FIG. 21, the bag opening pneumatic cylinder 224 causes the suction cups 253 and 254 to engage the exposed outer surface of the collapsed plastic bags 240 and 242, respectively, whereby the vacuum lines 227 and 228 create a suction on the plastic bags. The bag opening pneumatic cylinder 224 then retracts lifting the exposed outer surface of the plastic bag 230. At this time, the pneumatic cylinder 257 is engaged causing the horns 244 and 246 swing into the lifted plastic bags, and plunger 249 is engaged causing the stacks to load into the opened plastic bags.

Figure 22:
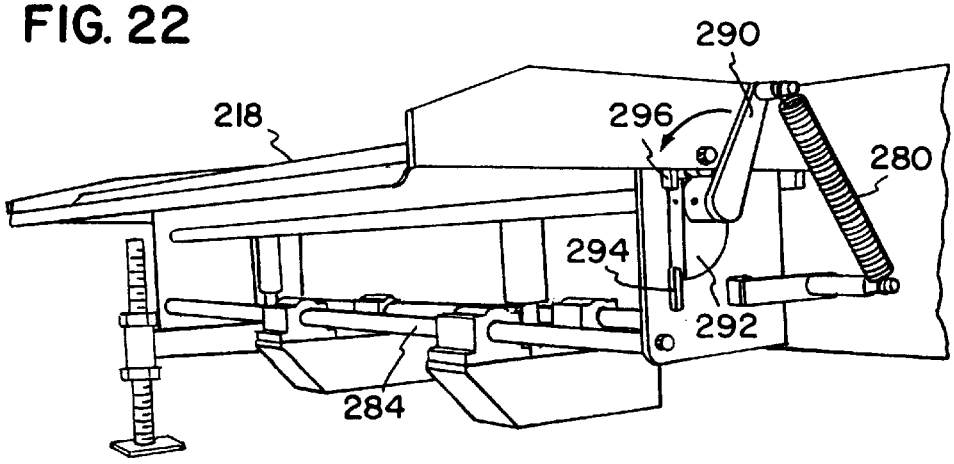
FIG. 22 is a perspective view of the loading platforms of the packaging apparatus shown in FIG. 19.

The loading platform 218 is described in more detail in FIG. 22, where it is shown in the home or released position. The loading platform 218 is shown in FIGS. 19–21 in the work position. As collapsible containers are loaded with product and removed from the loading platform 218, a bias is provided to push the loading platform 218 higher so that the level of the top collapsible container remains essentially constant when the loading platform is in the work position 218. It has been found that elevating the loading platform as collapsible containers are removed from the stack provides better results than having the suction cups descend further to engage the top surface of the top collapsible containers. In addition, pushing the loading platform 218 higher provides for more consistent dimensions of open collapsible containers which provides for better packaging.

The spring 280 is provided to bias the loading platform 218 upward and keep it in a locked position which means that the platform will not move horizontally when in the work position. If desired, another biasing force can be used to push the loading platform 218 upward. When the lever 290 is rotated in the direction of the arrow, a bias is provided by the spring 280 once the lever 290 advances beyond a certain point. The bias causes the cam elevator 292 to push the loading platform 218 upward. Thus, as collapsible containers are loaded with product and removed from the platform, the spring 280 pulls the lever 290 in a counter clockwise direction which causes the cam elevator 292 to push the loading platform 218 higher. The work position stop 294 is included to provide a limit of rotation of the cam elevator 292 in the work position. This limit can correspond to the use of all collapsible containers in the stack. Home position stop 296 is included to provide a limit of rotation of the cam 292 when the loading platform 218 is in the home position.

The loading platform 218 provides for easy and convenient replacement or change of collapsible containers. As shown in FIG. 22, the loading platform 218 is in the home position which means that it can move horizontally along the slide 284. Once a stack of collapsible containers is depleted, the loading platform 218 can be returned to the home position and moved along the slide 284 so that a fresh stack of collapsible containers can be provided at the packaging station 220. As shown in FIG. 19, a first stack of bags 300 is provided at the packaging station 220 and a second stack of bags 302 is provided for easy and quick replacement of the first stack of bags 300. Thus, one stack of collapsible containers can be opened and loaded at the packaging station 220 while another stack of collapsible containers is being placed onto the loading platform for subsequent use. The loading platform thereby allows the stacks of collapsible containers to be quickly replaced with minimal time delay in operating the packaging apparatus 12.

Although the loading platform 218 is manually operated, it is within the scope of the present invention to automate this part of the apparatus according to the teaching provided above and principles well known in the art. For example, sensors could be provided to detect when the bags in a stack have been exhausted, or the packaging controller can count the number of bags used in view of the number of bags provided per stack. The appropriated time, the controller could tell certain apparatus that the loading platform should be removed and to the bags replaced.

It should be appreciated that the apparatus 10 can be modified to inform the packaging controller 18 whether collapsible containers are present at the packaging station 220 for packaging, or whether the loading platform 218 has been lowered to exchange stacks of collapsible containers. This information would impact the function of the packaging apparatus 12 in packaging articles. As discussed above, it is an advantage of the present invention that it provides control over the processing of meat patties. Thus, the packaging controller 18 can inform the stacking controller 17 via the communicator 19 that the packaging apparatus 12 is or is not ready to accept more stacks.

A discussed above, the communicator 19 allows the stacking controller 17 and the packaging controller 18 to communicate. In a preferred embodiment of the present invention, the communicator is provided with signal sources 305, 307, and 308. It has been found that only three signals are needed to provide sufficient information to provide adequate control over the apparatus 10. The signals can simply be on/off signals. In a preferred embodiment, the signals sent by a pneumatic cylinder and received by a proximity sensor. For example, the signal source 305 can be used to inform the stacking controller 17 that the packaging apparatus 12 is prepared to accept product; the signal source 306 can be used to tell the stacking controller 17 to dump rows (a), (c), and (e) from the dumper assembly 150; and the signal source 307 can be used to tell the stacking controller 17 to dump rows (b) and (d) from the dumper assembly 150. Accordingly, if all rows are to dump, then signal sources 106 and 307 are activated. It should be appreciated that no rows will dump unless the signal source 305 is activated. Of course, the programming can be modified to provide different signals. Advantageously, the communicator design described above is simple enough to easily modify other apparatus which may be desirably attached to either the stacking apparatus 11 or the packaging apparatus 12.

In view of the above teachings, it should be apparent that various modifications can be made to the embodiment described above while remaining within the scope of the present invention. Some of the various modifications are described.

The capacity or throughput of the apparatus 10 can be adjusted as desired. For example, if it is desired to increase the capacity of the apparatus 10, one could open up all of lanes (*a*)–(*e*), increase the number patties stacked in the stacking column 64, and/or inform the stacking controller 17 or the packaging controller 18 of the change in throughput. Of course, modification can be made to provide an apparatus having more streams. It should be appreciated that the number of lanes being operated through the entire stacking apparatus without effecting its basic operation. Accordingly, the capacity of the stacking apparatus can be essentially unlimited. Alternatively, it may be desirable to provide two or more stacking apparatus in series.

Similarly, the packaging apparatus can be modified to increase its capacity for packaging articles. The rate limiting step is the opening of the collapsible bag and the ramming of articles therein. One way to increase capacity for packaging includes providing additional packaging stations functioning in parallel.

If it is desired to decrease the capacity of the apparatus 10, it is a simple matter to close off certain lanes and inform the stacking controller 17 or the packaging controller 18 of the change so it can slow the system down. Since the patties will not advance into the counting and stacking region 14 until all of the sensors 49 are satisfied, the apparatus 10 will naturally adjust to the rate articles are fed to it.

The stacking apparatus 11 and the packaging apparatus 12 can, if desired, be separated and operated independently. For example, it may be desirable to utilize a different packager in combination with the stacking apparatus 11. More likely, however, it may be desirable to package articles which are not stacks using the packaging apparatus 12. Such articles include bread, cuts of meat, non-food items, etc. It should be kept in mind, however, that the controllers 17 and 18 may require additional programming to operate effectively.

It should be kept in mind that many of the sprockets, chains, and other moving parts in the apparatus 10 are preferably covered with a shield during operation to prevent injury which could occur if fingers, clothing, etc. gets caught therein. The shields are not shown in the figures in order to more clearly demonstrate the operation of the apparatus. One skilled in the art would appreciate where shields belong. In order to increase the safety of the apparatus, sensors can be provided which will shut the apparatus down when a shield is removed.

The stacking apparatus 11 and the packaging apparatus 12 are preferably connected by two bolts (not shown) to ensure that they stay in proper alignment. There is no requirement, however, that they be connected together at any point. If desired, the detectible signals transmitted and received between the controllers 17 can be transmitted by radio, light or electromagnetic signals.

The stacking controller 17 and the packaging controller 18 are programmable logic controllers (PLC) which are preprogrammed to control the processing of frozen meat patties through the apparatus 10. Any conventional PLC can be used including a FANUC 90-30 controller by General Electric Corp. One skilled in the art would readily appreciate how to program such controllers, particularly in view of the following described operations of the apparatus 10 and the placement of the sensors which are described in detail below.

The in-feed conveyor 22 can be any type of conveyor material useful in processing food, such as a woven wire belt having ⅜" pitch wire.

In general, any commercially available inductive proximity sensor can be used as the proximity sensors described by the present invention. An exemplary inductive proximity sensor is manufactured by Electromatic Controls Corp.

While the invention has been described in conjunction with a specific embodiment thereof, it is evident that different alternatives, modifications, variations, and uses will be apparent to those skilled in the art in view of the foregoing description. Accordingly, the invention is not limited to these embodiments or the use of elements having specific configurations and shapes as presented herein.

What is claimed is:

1. An apparatus for stacking and packaging articles comprising:

a stacker for stacking stackable articles in a column, wherein said stacker comprises:

a stacking cam rotationally mounted on an axis to provide a 360 degree rotation, said stacking cam having a protecting surface and a lifting surface, the protecting surface and the lifting surface being constructed and arranged to provide a receiving area where an article is received for stacking;

a disengagement wall for removing an article from the receiving area of said stacking cam; and a column container for holding stacked articles;

a stack mover for moving a stack of articles stacked by said stacker to a packaging station, wherein said stack mover comprises:

a sliding surface having a surface which is sufficiently smooth to allow a stack of articles to slide thereacross;

a pusher for moving a stack across said sliding surface; and a dumper assembly pivotably mounted to rotate between a first position and a second position, said dumper assembly comprising a receiving surface and a rotatable semi-cylinder, wherein the receiving surface is sufficiently continuous and coplanar with said sliding surface for receiving a stack therefrom when said dumper assembly is in the first position, and the rotatable semi-cylinder being constructed and arranged to support and release a stack when said dumper assembly is in the second position;

a packager for packaging a stack of articles at the packaging station in a collapsible bag, wherein said packager comprises:

a packaging station for loading a stack of articles into a collapsible bag;

collapsible bag at said packaging station, said bag having a bottom side which is fixed in position at said packaging station and a top side which is free to move relative to the bottom side;

collapsible bag lifter for engaging and holding the top side of the collapsible bag, and which rises to provide an open bag; and plunger for pushing a stack of articles at the packaging station into the open bag.

2. The apparatus for stacking and packaging articles according to claim 1, wherein said packager further comprises a bucket for receiving a stack released from said stack mover and conveying to the packaging station.

3. The apparatus for stacking and packaging articles according to claim 1, further comprising a horn for insertion into an open bag to hold the bag open.

4. The apparatus for stacking and packaging articles according to claim 1, wherein said apparatus does not utilize pressurized air for inflating the collapsible bag.

5. The apparatus for stacking and packaging articles according to claim 1, wherein said plunger provides a pressure sufficient to detach a collapsible bag containing a stack of articles therein from the packaging station and the collapsible bag lifter.

6. The apparatus for stacking and packaging articles according to claim 1, wherein said collapsible bag lifter comprises suction cups for engaging and holding the top side of the collapsible bag.

7. The apparatus for stacking and packaging articles according to claim 1, further comprising food products for stacking and packaging.

8. The apparatus for stacking and packaging articles according to claim 7, wherein the food products are stacks of meat patties.

9. A method for stacking and packaging articles comprising steps of:

feeding articles to a stacker, wherein said stacker comprises:

a stacking cam rotationally mounted on an axis to provide a 360 degree rotation, said stacking cam having a protecting surface and a lifting surface, the protecting surface and the lifting surface being constructed and arranged to provide a receiving area where an article is received for stacking;

a disengagement wall for removing an article from the receiving area of said stacking cam; and a column container for holding stacked articles;

stacking said articles in a column by adding articles until a predetermined number of articles are stacked;

transferring the predetermined number of stacked articles to a packaging station for loading into a collapsible bag, wherein the step of transferring includes operating a stack mover comprising:

a sliding surface having a surface which is sufficiently smooth to allow a stack of articles to slide thereacross;

a pusher for moving a stack across said sliding surface; and a dumper assembly pivotably mounted to rotate between a first position and a second position, said dumper assembly comprising a receiving surface and a rotatable semi-cylinder, wherein the receiving surface is sufficiently continuous and coplaner with said sliding surface for receiving a stack therefrom when said dumper assembly is in the first position, and the rotatable semi-cylinder being constructed and arranged to support and release a stack when said dumper assembly is in the second position;

opening a collapsible bag at the packaging station, the collapsible bag including a bottom side which is attached to the packaging station and a top side which is not attached, comprising lowering a collapsible bag lifter which attaches to the top side of the collapsible bag, and lifting the collapsible bag lifter to provide an open bag; and pushing said stack in the open bag.

10. The method for stacking and packaging articles according to claim 9, wherein said step of opening a collapsible bag excludes injecting air into the collapsible bag.

11. The method for stacking and packaging articles according to claim 9, further comprising inserting a horn into the open bag to hold the bag open.

12. The method for stacking and packaging articles according to claim 9, wherein said step of pushing comprises providing a plunger with sufficient pressure to push said stack into the open bag and detach the open bag from the packaging station and the collapsible bag lifter.

13. The method for stacking and packaging articles according to claim 9, wherein said collapsible bag lifter comprises suction cups for engaging and holding the top side of the collapsible bag.

14. The method for stacking and packaging articles according to claim 9, wherein the articles comprise food products.

15. The method for stacking and packaging articles according to claim 14, wherein the food products are meat patties.

* * * * *